US008146218B1

(12) United States Patent
Ealer, Sr. et al.

(10) Patent No.: US 8,146,218 B1
(45) Date of Patent: Apr. 3, 2012

(54) METHOD FOR MAKING SOLID EDGE GUTTER SCREEN

(76) Inventors: James E. Ealer, Sr., St. Clair, MO (US); James E. Ealer, Jr., Steelville, MO (US)

( * ) Notice: Subject to any disclaimer, the term of this patent is extended or adjusted under 35 U.S.C. 154(b) by 1044 days.

(21) Appl. No.: 11/873,690

(22) Filed: Oct. 17, 2007

Related U.S. Application Data

(63) Continuation-in-part of application No. 11/105,653, filed on Apr. 14, 2005, now abandoned.

(51) Int. Cl.
*B21D 31/02* (2006.01)

(52) U.S. Cl. ..... 29/6.2; 29/6.1; 29/896.6; 29/896.62; 52/12; 72/362; 72/379.2

(58) Field of Classification Search ..... 29/6.1, 29/6.2, 896.6, 896.61, 896.62, 730, 731; 72/379, 377.2, 362, 176–183, 385; 52/12
See application file for complete search history.

(56) References Cited

U.S. PATENT DOCUMENTS

| | | | | | |
|---|---|---|---|---|---|
| 1,597,503 | A | | 8/1926 | Andrews | |
| 1,676,517 | A | | 7/1928 | Birkholz | |
| 2,175,521 | A | | 10/1939 | Fry | |
| 2,209,741 | A | | 7/1940 | Sullivan | |
| 2,271,081 | A | | 1/1942 | Layton | |
| 2,609,781 | A | * | 9/1952 | Gruetjen | 29/6.2 |
| 2,828,792 | A | * | 4/1958 | Hill | 72/313 |
| 2,988,226 | A | | 6/1961 | Campbell | |
| 3,011,244 | A | * | 12/1961 | Halada | 29/6.2 |
| 3,067,881 | A | | 12/1962 | Goosmann | |
| 3,108,406 | A | | 10/1963 | Ellis | |
| 3,218,689 | A | * | 11/1965 | Mumma | 29/6.2 |
| 3,351,206 | A | | 11/1967 | Wennerstrom | |
| 3,388,555 | A | | 6/1968 | Foster | |
| 3,774,274 | A | | 11/1973 | Jury | |
| 3,812,558 | A | | 5/1974 | Watanabe | |
| 3,950,951 | A | | 4/1976 | Zukauskas | |
| 4,305,187 | A | | 12/1981 | Iwamura | |
| 4,307,976 | A | | 12/1981 | Butler | |
| 4,418,504 | A | | 12/1983 | Lassiter | |
| 4,631,875 | A | | 12/1986 | Olson | |
| 4,727,689 | A | | 3/1988 | Bosler | |
| 4,750,300 | A | | 6/1988 | Winger, Jr. | |
| 4,769,957 | A | | 9/1988 | Knowles | |
| 4,796,390 | A | | 1/1989 | Demartini | |
| 4,841,686 | A | * | 6/1989 | Rees | 52/12 |
| 4,905,427 | A | | 3/1990 | McPhalen | |
| 4,907,381 | A | | 3/1990 | Ealer | |
| 4,936,061 | A | | 6/1990 | Palma | |
| 4,937,986 | A | | 7/1990 | Way, Sr. | |
| 4,941,299 | A | | 7/1990 | Sweers | |

(Continued)

OTHER PUBLICATIONS

Gutter World, Inc., Price List, Aug. 1, 1985, 4 pages.

(Continued)

*Primary Examiner* — Richard Chang
(74) *Attorney, Agent, or Firm* — Senniger Powers LLP

(57) ABSTRACT

Method and apparatus for continuously forming a one-piece expanded metal gutter cover having at least one solid edge. The method involves feeding a continuous web of solid metal along a continuous path, expanding the continuous web as it is fed along the continuous path, profiling a solid edge margin of the web as it is fed along the continuous path, and cutting the continuous web transversely of the web at intervals along the web to form separate gutter covers.

16 Claims, 28 Drawing Sheets

U.S. PATENT DOCUMENTS

| | | | | | |
|---|---|---|---|---|---|
| 5,072,551 | A | | 12/1991 | Manoogian, Jr. | |
| 5,081,814 | A | | 1/1992 | Singletary | |
| 5,092,086 | A | | 3/1992 | Rognsvoog, Sr. | |
| 5,095,666 | A | | 3/1992 | Williams, Jr. | |
| 5,103,601 | A | | 4/1992 | Hunt | |
| 5,109,640 | A | | 5/1992 | Creson | |
| 5,251,410 | A | | 10/1993 | Carey | |
| 5,271,191 | A | | 12/1993 | Vahamaki | |
| 5,271,192 | A | | 12/1993 | Nothum, Sr. | |
| 5,406,754 | A | | 4/1995 | Cosby | |
| 5,438,803 | A | * | 8/1995 | Blizard, Jr. | 52/12 |
| 5,522,183 | A | | 6/1996 | Allen | |
| 5,619,825 | A | | 4/1997 | Leroney | |
| 5,709,051 | A | | 1/1998 | Mazziotti | |
| 5,778,626 | A | * | 7/1998 | Hellsten | 52/844 |
| 5,813,173 | A | | 9/1998 | Way, Sr. | |
| 5,842,311 | A | | 12/1998 | Morin | |
| 5,893,240 | A | | 4/1999 | Ealer, Sr. | |
| 6,151,837 | A | | 11/2000 | Ealer, Sr. | |
| 6,944,942 | B2 | * | 9/2005 | Marlow | 29/731 |
| 6,951,077 | B1 | | 10/2005 | Higginbotham | |
| 2004/0006927 | A1 | * | 1/2004 | Wickett | 52/12 |

OTHER PUBLICATIONS

Gutter World, Inc., The Ultimate Guards brochure, 1985, 2 pages.
McNichols, Flattened Expanded Metal web page, http://www.mcnichols.com/products/expanded/flat, 3 pages, admitted prir art.
McNichols, Standard Expanded Metal Details web page, http://www.mcnichols.com/products/expanded/standard/em_stdrd2.htm, 5 pages, admitted prior art.
McNichols, Tolerance Specifications for Expanded metal web page, http://www.mcnichols.com/products/expanded/tables/em_tol.htm, 2 pages, admitted prior art.
TWP, Inc., Galvanized Hardware Cloth web page, http://www.twpInc.com/galvanized.html, 3 pages, admitted prior art.
Sankey, Expanded Metal Product Guide, 6/12, 1st edition, Australia, 12 pages.
Office action dated Oct. 24, 2007, U.S. Appl. No. 11/105,653, 24 pages.

* cited by examiner

METHOD FOR MAKING SOLID EDGE GUTTER SCREEN

This continuation-in-part application claims the benefit of the filing date of U.S. patent application Ser. No. 11/105,653, filed Apr. 14, 2005. The entire text of the above-referenced application is hereby incorporated herein by reference.

BACKGROUND OF THE INVENTION

This invention relates generally to rain gutters, and more particularly to a method of making a solid edge gutter screen for such gutters.

Since leaves and other debris frequently clog up rain gutters, some kind of guard or screen which prevents leaves from falling into the gutter is desirable. However, cheap conventional gutter screens may become overburdened by such debris and collapse into the gutter, thereby aggravating the problem instead of solving it.

One popular type of gutter screen S (FIG. 9) is designed so that the back edge slides under the shingles and the front edge lies on top of the gutter. This screen has diamond-shaped holes extending transverse to a longitudinal axis of the screen. The long edges LE (the front and back edges) are very sharp due to the orientation of the holes, and the sharp back edge often snags against the shingles, making it hard to install. Also, there is a significant risk the installer will cuts his hands on these sharp edges. Despite these drawbacks, this screen is sold because it is cheap to manufacture, requiring limited manual labor. The screen is formed by feeding a coil of metal into an expanding machine in a continuous process. Some screens eliminate the sharp front edge by covering it with a solid metal bar that is made separate from the screen portion. This metal bar is roll-formed into a Z-shaped cross-section on a roll-former machine. The front edge of the screen is inserted into one of the channels of the Z-shaped cross-section. A pinch roller pinches the channel to fasten the bar and the screen together. The front edge thereby has a solid smooth front edge, and the risk of cutting the installer's hands is reduced or eliminated. However, the back edge is left very sharp and can still snag the shingles.

Another popular screen has what is called a "bonded edge," meaning that the diamond-shaped openings extend longitudinally, rather than transverse to the screen length. This screen is also produced using an expanding machine, but is produced "by length size". Importantly, the length size is actually determined by the width of the input coil, rather than input coil length. For example, a 4 foot long screen uses a 4 foot wide coil. If the product design requires a 5 inch wide by 4 foot long section, the expanding machine is set for 5 inches. When the expanded material reaches 5 inches, the machine must stop, the material is then sheared and the expanding machine starts over. The operator stacks the loose sections and moves them to a roll-former to bend or form a desired screen profile. At this secondary roll-former station, the operator manually inserts each piece through the roll-former to produce a finished screen.

This latter screen is more expensive than the first-mentioned screen because of all the manual labor and time required in manufacturing. However, the screen is an improvement over the above-mentioned screen because of the semi-smooth long edges or "bonded edges." While each bonded edge is irregular in shape due to the diamond holes, it is not a sharp edge. With the smoother long edges, the operator will not cut his hands during installation, and the back edge will not snag on the shingles. Thus, though it is higher priced, the screen is easier to install.

The gutter screen of U.S. Pat. No. 4,907,381 represents one satisfactory solution to the above problems. However, the process of making this gutter screen is also time-consuming and relatively expensive. Moreover, the material required is relatively heavy and expensive.

SUMMARY OF THE INVENTION

In one aspect, the invention is directed to a method of continuously forming a one-piece expanded metal gutter cover having a length, a width, and at least one solid edge extending along the cover at one side of the cover. The method comprises feeding a continuous web of solid metal along a continuous path, the continuous web having side edges extending lengthwise of the web. The web is expanded as it is fed along the continuous path to form an expanded web of material having an expanded metal screen section with holes of substantially uniform size and shape, a first side edge margin along one side of the web of solid unperforated metal, and a second side edge margin along an opposite side of the web. After the expanding has occurred, a gutter cover profile is formed in the first solid side edge margin as the continuous web is fed along the continuous path. The profile has a configuration for installation on a gutter. After the forming has occurred, the continuous web is cut transversely of the web at intervals along the web to form separate gutter covers. Each interval corresponds to the length of a gutter cover.

Another aspect of this invention is directed to a system for continuously making one-piece expanded metal gutter covers having a length, a width, and at least one solid edge extending along the cover at one side of the cover. The system comprises apparatus for feeding a continuous web of solid metal along a continuous path, the continuous web having side edges extending lengthwise of the web. Apparatus is provided for expanding the continuous web as it is fed along the continuous path to form an expanded web of material having an expanded metal screen section with holes of substantially uniform size and shape, a first side edge margin along one side of the web of solid unperforated metal, and a second side edge margin along an opposite side of the web. The system also includes apparatus for profiling the first solid side edge margin as the continuous web is fed along said continuous path, and apparatus for cutting the continuous web transversely of the web at intervals along the web to form separate gutter covers, each interval corresponding to the length of a gutter cover.

Other features of the present invention will be in part apparent and in part pointed out hereinafter.

DESCRIPTION OF PREFERRED EMBODIMENTS

Figure 1:
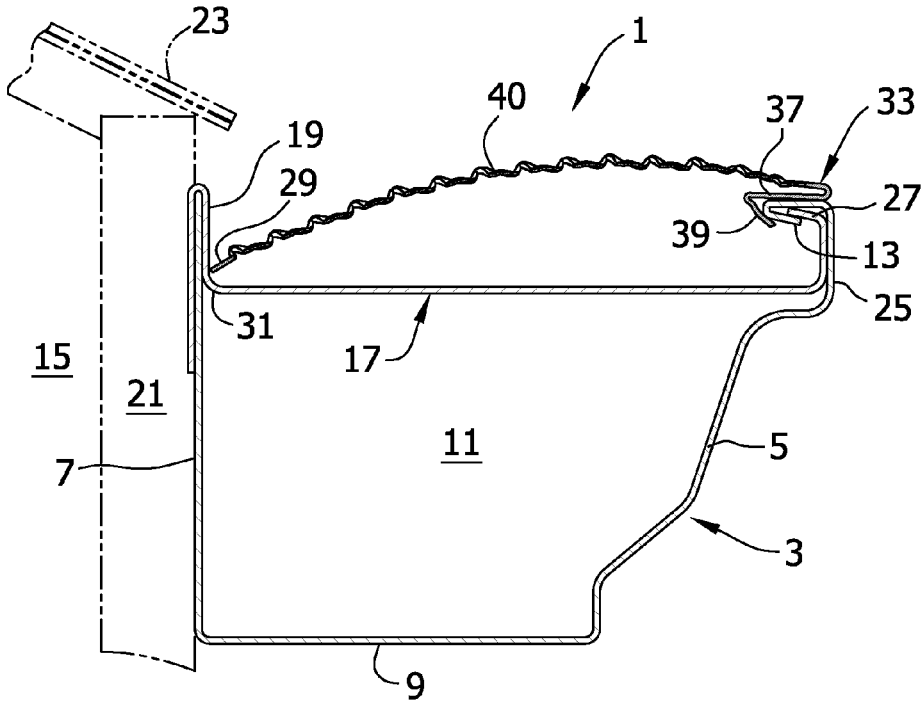
FIG. 1 is a transverse cross-section of a gutter screen of one embodiment on a gutter.
Figure 2:
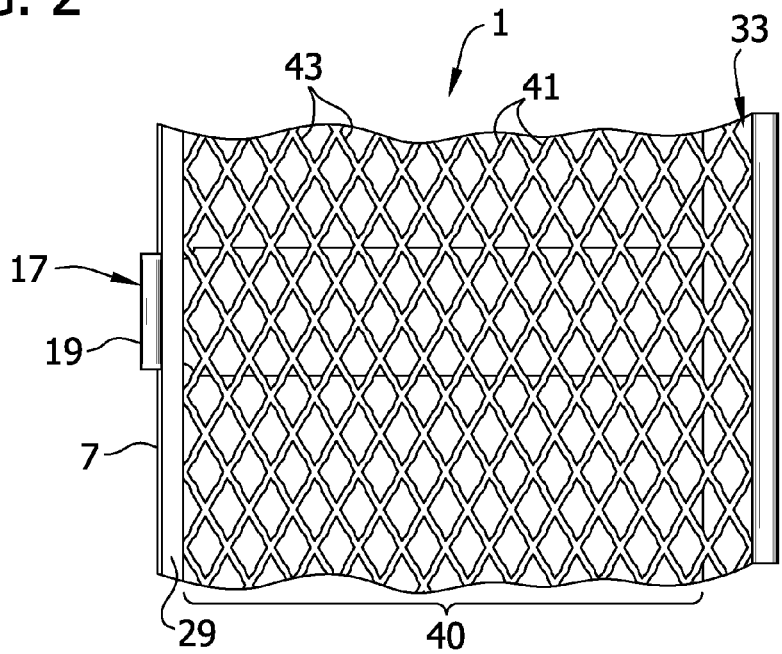
FIG. 2 is a top plan view of the gutter screen and gutter of FIG. 1.

Now referring to FIGS. 1 and 2, a gutter screen of one embodiment of the present invention is designated in its entirety by the reference numeral 1. Gutter screen 1 is particularly adapted for covering a conventional rain gutter, such as indicated generally at 3, and preventing leaves, debris and the like from falling into the gutter. Note that the gutter screen is not made of hardware cloth or wire mesh.

As shown in FIG. 1, gutter 3 has a front wall 5, a back wall 7 and a bottom wall 9, which form a channel 11 for drainage of rainwater. Front wall 5 may be provided with a decorative and/or strengthening configuration, as shown. A conventional lip or flange 13 projects rearward from the front wall 5 and is spaced above the bottom wall 9 of the gutter 3. The flange 13 extends substantially continuously along the entire length of the gutter 3.

Gutter 3 is suitably attached to the outside wall 15 of a building by gutter hangers, one of which is shown and designated 17. The hanger 17 has a back portion 19 bent to hook over the back wall 7 of gutter 3 and adapted to receive a fastening device, such as a screw or nail, to secure the gutter to a cornice or fascia 21 on wall 15 adjacent the roof 23. Hanger 17 extends over channel 11 to a section 25 of front wall 5 under flange 13 to support the front wall and reinforce it against inwardly directed pressures. A front portion 27 of hanger 17 is bent to fit inside flange 13 to reinforce the front wall 5 against outwardly directed forces.

The gutter screen 1 has an integral rear edge margin 29 adapted for engaging a bend 31 on hanger 17 adjacent back wall 7 of the gutter 3, and an integral front edge margin 33 extending generally parallel to the rear edge margin. Front edge margin 33 is bent to form a forwardly-opening channel 35 having a generally V-shaped configuration in transverse section and is thereby adapted for receiving flange 13 therein. For example, a rearward extending upper portion 37 may be bent back from the front edge 33 of the screen member 1 so as to extend generally parallel to the screen member, and a forwardly extending lower portion 39 may be bent forward from the upper portion at an angle of approximately forty-five degrees therefrom to form channel 35. Upper and lower portions 37, 39 are divergent in the forward direction relative to the channel 35 to form a relatively wide channel mouth for ready passage of the gutter flange 13 through the mouth into a position where the flange is disposed between the portions and the screen 1 is thereby securely engaged in the gutter 3. The upper and lower portions 37, 39 engage the gutter flange 13 substantially continuously along the entire length of the screen 1.

The gutter screen 1 is formed of flexible resilient metal, such as an aluminum alloy or steel alloy, and is of integral construction, i.e., it is formed from a single continuous piece of metal. The integral rear edge margin 29 and the integral front edge margin 33 are both solid, unperforated metal. This solid, unperforated metal strengthens the screen 1. This strengthening function allows a lighter, less expensive material, such as aluminum alloy to be used. The solid long edges are not sharp like the prior art, thus enabling safer handling and easier installation.

An expanded metal screen section 40, disposed between the rear and front edge margins 29, 33, is adapted to cover the gutter channel 11. The screen section includes criss-crossing ribs 41, 43 extending at non-perpendicular angles.

In a second embodiment 1' (FIG. 4), the criss-crossing ribs 41', 43' continue into the front edge margin 33'. As shown, only a small area of the upper portion 37' is solid metal. But the lower portion 39' of the channel 35' is made entirely of solid, unperforated metal.

Figure 3:
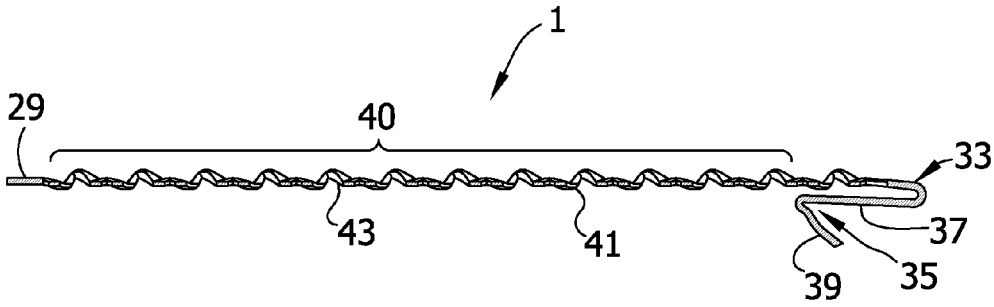
FIG. 3 is a transverse cross-section of the gutter screen but showing the screen unbent prior to installation in the gutter.
Figure 4:
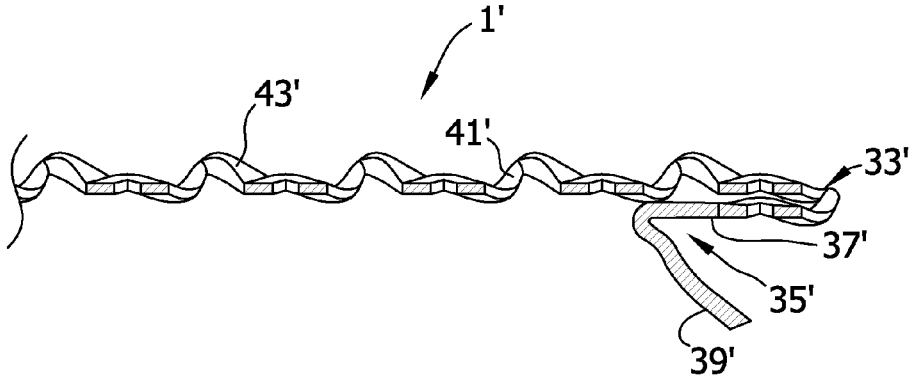
FIG. 4 is a transverse cross-section of another embodiment of the gutter screen.

The width of the gutter screens 1, 1' (i.e., from front edge margin to rear edge margin) is greater than the width of the gutter 3 (i.e., between bend 31 of the hanger 17 and flange 13) so that the screen may be resiliently bent to the arcuate configuration shown in FIG. 1 wherein the front edge margin and rear edge margin of the screen member are in pressure (spring-like) engagement with the gutter and gutter hanger, respectively, thereby securely to maintain the gutter screen on the gutter until such time as it is manually removed. The arched configuration of the screens 1, 1' also increases the load-bearing capability of the screens. As shown in FIGS. 3 and 4, however, the screen section is generally planar when uninstalled.

Figure 5:
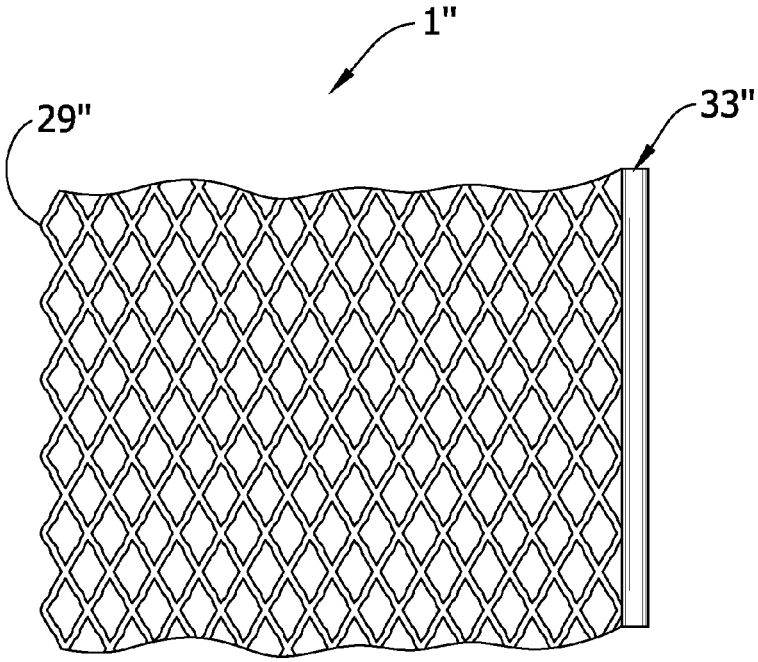
FIG. 5 is a fragmentary plan view of another embodiment of the gutter screen.

In another embodiment shown in FIG. 5, gutter screen 1" includes a front edge margin 33" that is not bent. However, the front edge margin is solid, unperforated metal.

The rear edge margin 29" is a bonded edge, meaning that it is smooth, but not solid metal. In another embodiment, screen 1'" shown in FIG. 6, the rear edge margin 29'" also includes solid, unperforated metal.

Figure 7:
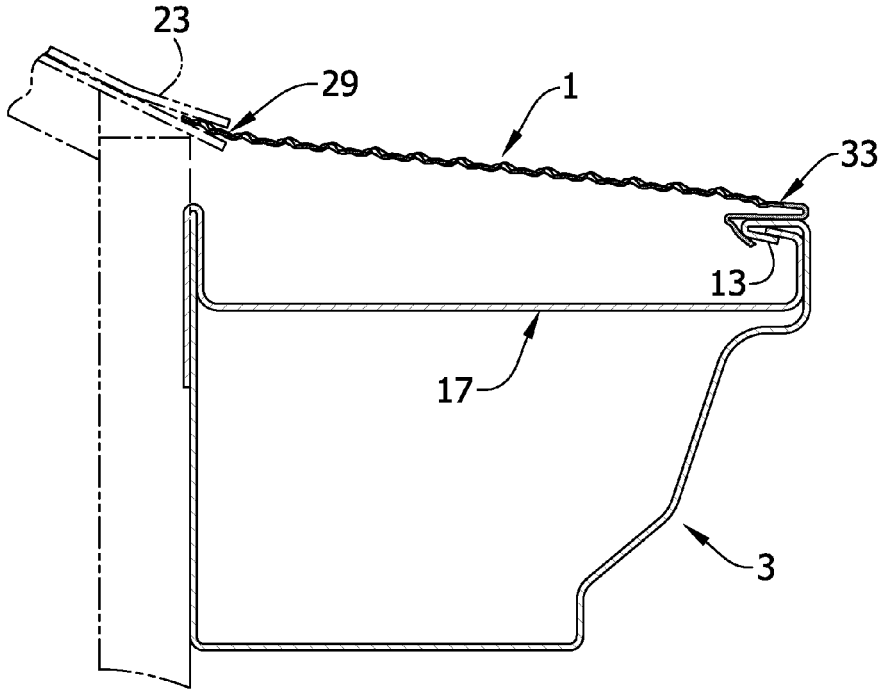
FIG. 7 is a transverse cross-section of a gutter screen of still another embodiment on a gutter.
Figure 8:
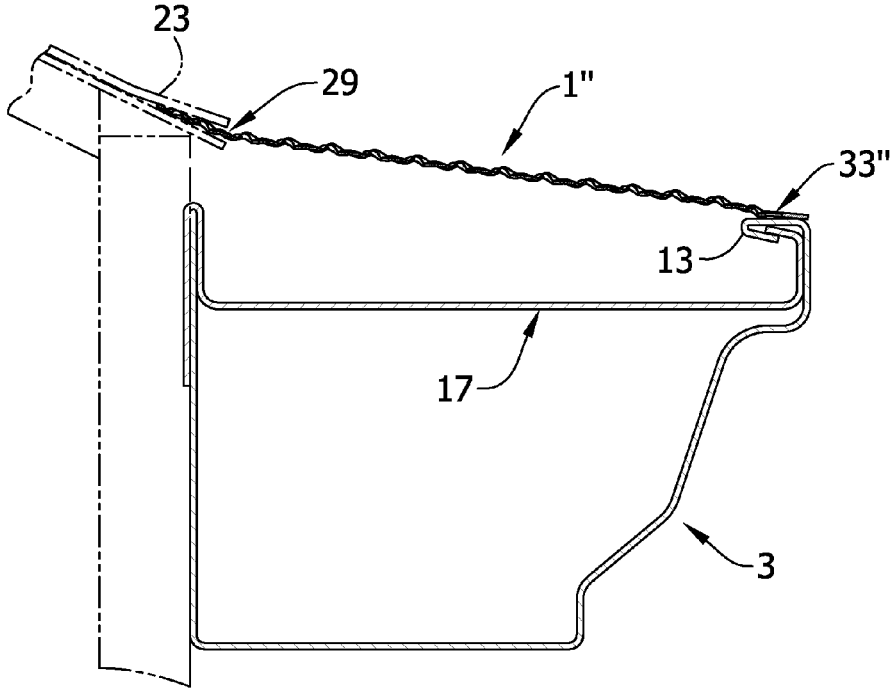
FIG. 8 is a transverse cross-section similar to FIG. 7 but showing the screen of FIG. 6 on a gutter.
Figure 9:
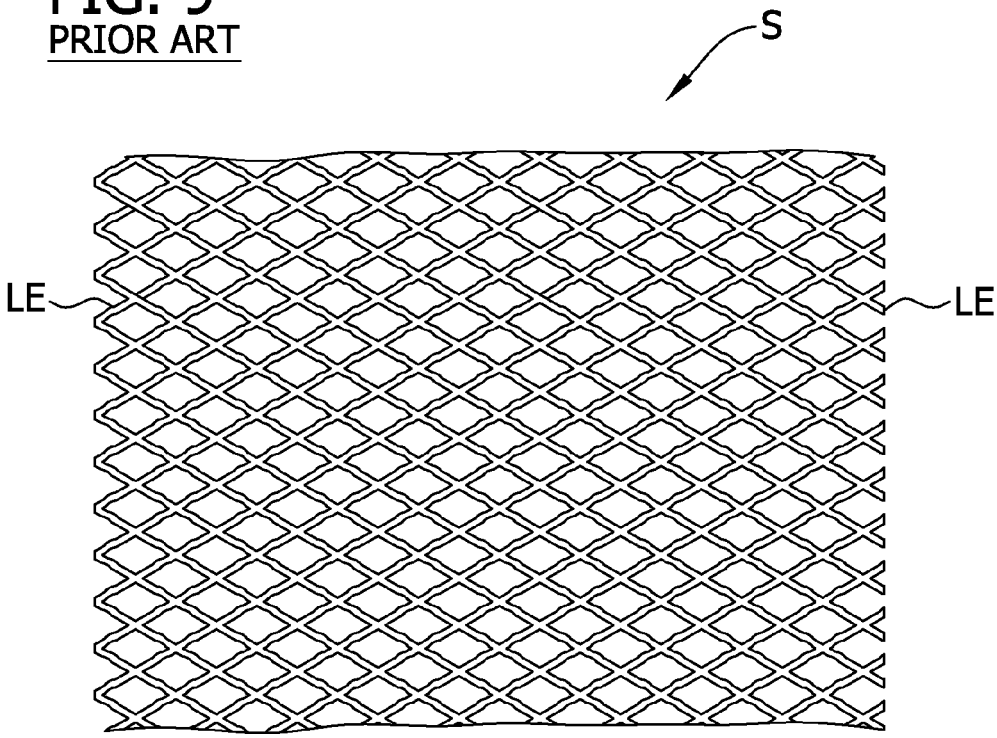
FIG. 9 PRIOR ART
FIG. 9 is a fragmentary plan view of a prior art gutter screen.

The screens of this invention may be secured in other ways. For example. In FIG. 7, the rear edge margin 29 of the screen 1 is slipped under the shingles and the front edge margin 33 is secured to the gutter flange as described above. In FIG. 8, the front edge margin 33" of screen 1" simply rests on the gutter flange 13.

Gutter screens of the invention are suitably manufactured in an expanding machine, though other manufacturing methods are contemplated within the scope of the invention. For example, a coil of metal can be slit and expanded in a one-step process that is less expensive and faster than prior art manufacturing methods.

As described in the Background section, many "expanded metal" screen products have disadvantages because they are either cheaply manufactured with sharp edges or produced with a more costly semi-smooth bonded edge. A new method of expanding a gutter screen is possible with a new expanding machine that combines the economical expanded width method with smooth long edges. In other words, this new method eliminates the sharp long edges without the costly manual labor required in the above-described secondary stage of roll-forming. This new method forms a screen having either a solid single edge and a bonded edge (FIG. 5), or two solid edges (FIGS. 1-4 and FIG. 6), and does so efficiently by coil length, rather than by coil width. There are no machines on the market that produce a single solid edge (or two solid edges) by coil length, and such screens have not been used in the gutter industry. There are also expanding machines that produce expanded screen coil with a semi-smooth bonded edge, like in the plaster lath industry. The plaster lath industry does not require precise dimensional control. Plaster lath is non-uniform, with holes that are too large for use as gutter screens.

This new gutter screen can now be economically designed with the precise tolerance needed because of advancements made in expanding machines. The precise tolerance relates to the screen strand width and the length and width of the holes.

Figure 10:
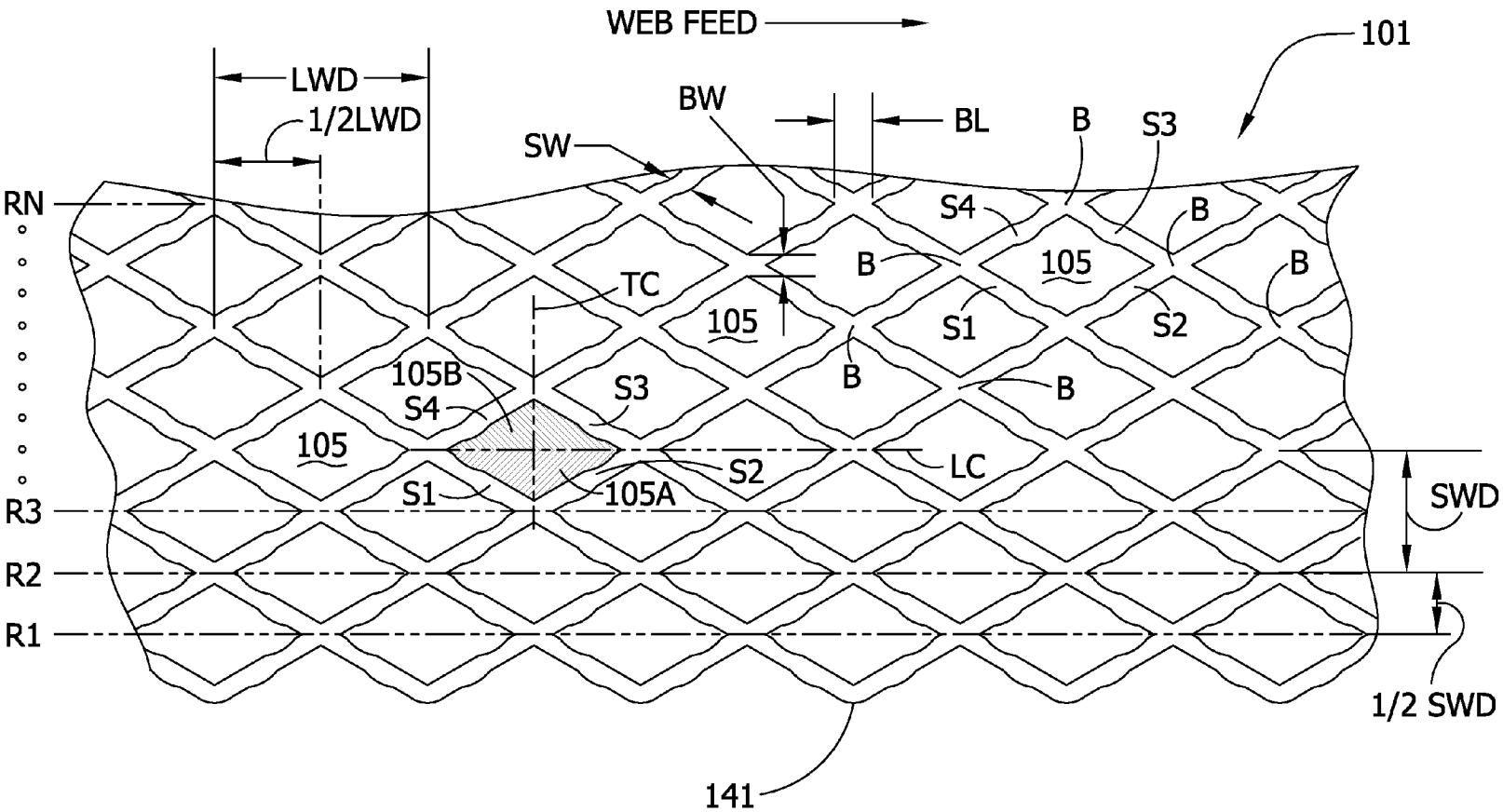
FIG. 10 is a view showing an expanded metal section of a gutter cover made in accordance with this invention.

FIG. 10 illustrates a fragment 101 of a gutter cover of this invention having an expanded metal section with a typical arrangement of holes 105. Each hole 105 has a non-circular shape, e.g., a diamond shape. Each hole or "diamond" has a long dimension, (commonly referred to as LWD) of between 0.25 and 0.63 inches, e.g., about 0.50 inches. This long dimension LWD extends generally parallel to the length or long dimension of the gutter cover. Each diamond also has a short dimension (SWD) of between 0.13 and 0.38, e.g., about 0.25 inches. This short dimension SWD extends generally at right angles to the longitudinal or long dimension of the gutter cover. (The long and short dimensions are significantly smaller and more uniform than the dimensions of lath holes which have a long dimension varying from 0.75 to 1.00 inch and a short dimension varying from 0.38 to 0.50 inches.) The diamonds are arranged in a plurality of parallel longitudinal rows R1, R2 . . . RN extending lengthwise or longitudinally of the gutter cover. In a typical arrangement, the spacing between the longitudinal centerlines of diamonds in adjacent rows R of diamonds is equal to 0.5 SWD, and the diamonds in each longitudinal row R are offset a distance equal to 0.5 SWD relative to the diamonds in an adjacent longitudinal row.

The diamonds 105 are defined by strands S of metal having a generally uniform strand width SW (e.g., 1/16 in.). As viewed in FIG. 10, each diamond is defined by four strands S1-S4. The diamonds are connected by areas B referred to as "bonds", each of which has a bond length BL extending lengthwise of the web and a bond width BW extending widthwise of the web. The bond width BW is equal to two strand widths SW. These dimensions can vary. Further, the holes may have shapes other than diamond, e.g., other polygons.

Figure 11:
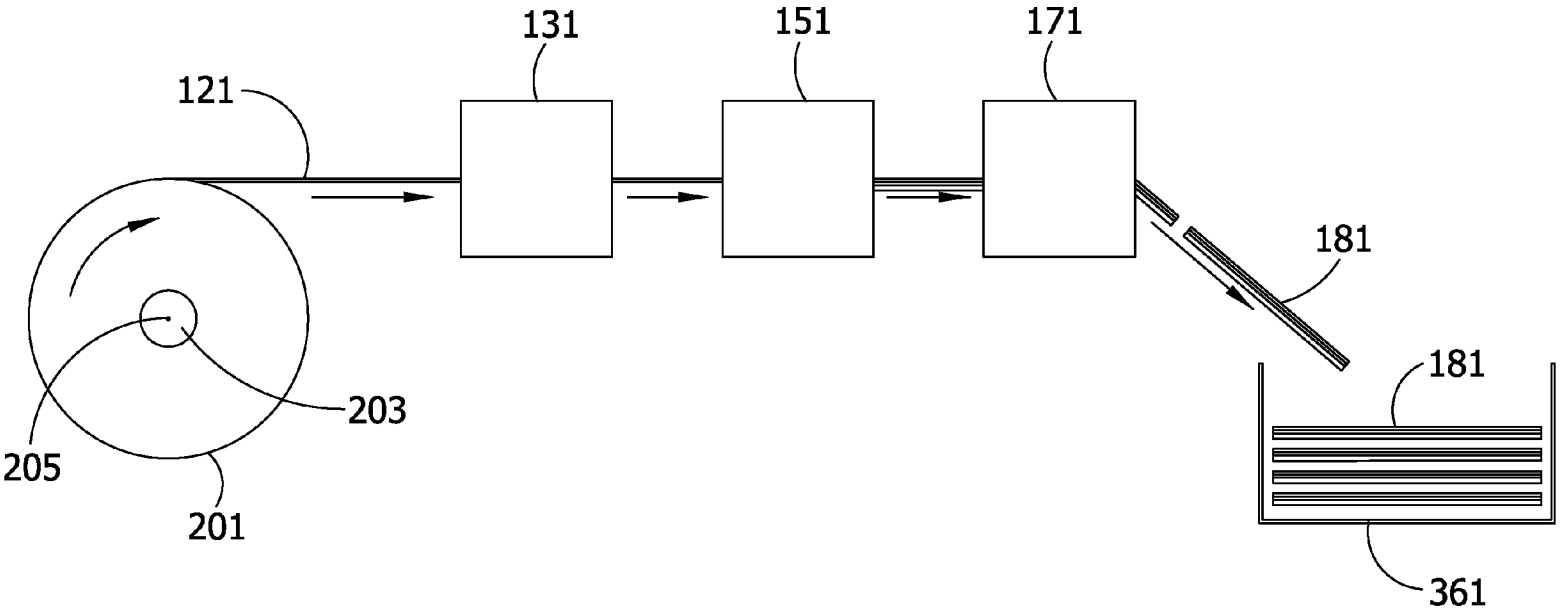
FIG. 11 is a schematic side view of a system of this invention for making a one-piece expanded metal gutter cover having at least one solid edge.
Figure 12:
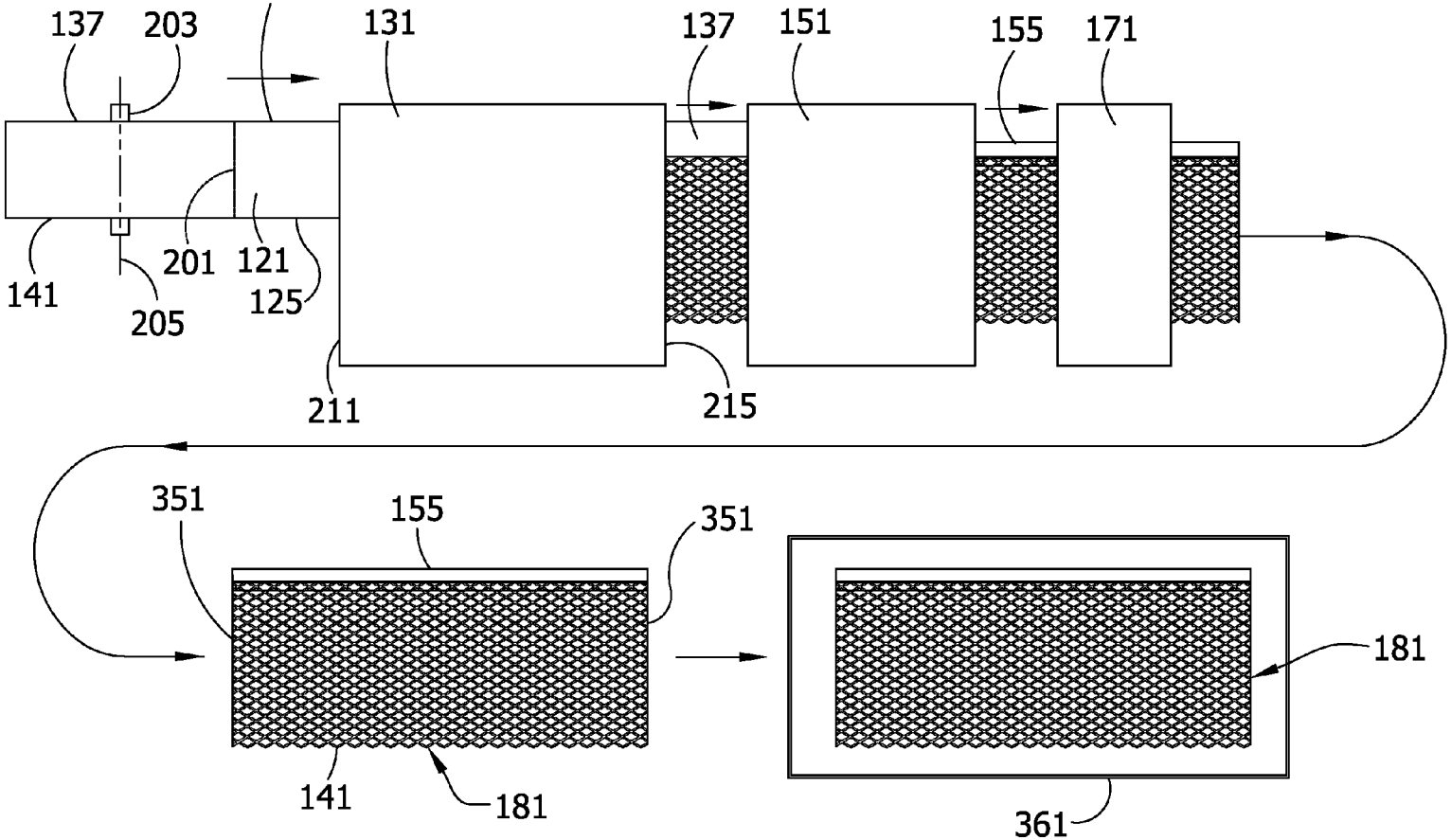
FIG. 12 is a schematic top plan view of the system of FIG. 10.

FIGS. 11-12 schematically illustrate a system of this invention for carrying out a method of continuously forming a one-piece expanded metal gutter cover having at least one solid edge, as described above. In general, the method comprises feeding a continuous web 121 of solid metal along a continuous path 123, e.g., from left to right in FIGS. 11 and 12. The web 121 has a length extending in the direction of feed (from left to right in FIGS. 11 and 12) and a width extending transverse to the direction of feed, and opposite side edges 125 extending lengthwise of the web. Expanding apparatus 131 is provided along the path for expanding the continuous web in a widthwise direction (i.e., in a direction extending generally transverse to the length of the web) to form an expanded web of material having an expanded metal section 135 with holes of substantially uniform size and shape, a first side (front) edge margin 137 along one side of the web of solid unperforated metal to facilitate safe handling of the screen and ease of installation of the gutter cover on a gutter, and a second side (rear) edge margin 141 along the other side of the web. Profiling apparatus 151 is provided downstream from the expanding apparatus 131 for forming a gutter cover profile 155 in the front edge margin 137 as the continuous web is fed along the continuous path 123. As shown for example in FIG. 3, the profile 155 has a configuration for installation on a gutter. Cutting apparatus 171 is provided downstream from the profiling apparatus 151 for cutting (e.g., shearing) the continuous web 121 transversely of the web at intervals along the web to form separate gutter covers 181. Each of the feeding, expanding, profiling and cutting steps is described in more detail below.

The continuous web 121 may be of any suitable metal, including steel or aluminum. The ability of the present invention to use aluminum is particularly advantageous because the resulting gutter covers are light. Further, aluminum is softer and more formable than steel and therefore is particularly suitable for use in the method of this invention. Before being expanded, the web 121 has a width in the transverse direction which is substantially less than the width of a finished gutter cover 181 (i.e., the front to rear dimension of the gutter cover). By way of example, the solid web 121 may have a width (i.e., a coil width) of three in., a width of six inches after the expanding step, and a width of about 5 in. after the profiling step.

Regarding the feeding step, the web 121 of solid material is pulled from a supply 201 of such material. By way of example, the web may be pulled from a coil 201 of metal mounted on a shaft 203 for rotation about an axis 205 extending generally transverse to the direction of feed. The web 121 is fed from the coil 201 in a direction extending lengthwise of the web in any suitable manner. By way of example, the expanding apparatus may pull the web from the coil. Alternatively or in combination, one or more powered feed rolls (not shown) may pull the web from the coil. Alternatively, the shaft 203 mounting the coil may be driven to feed or assist in the feeding of the web along the path.

Figure 13:
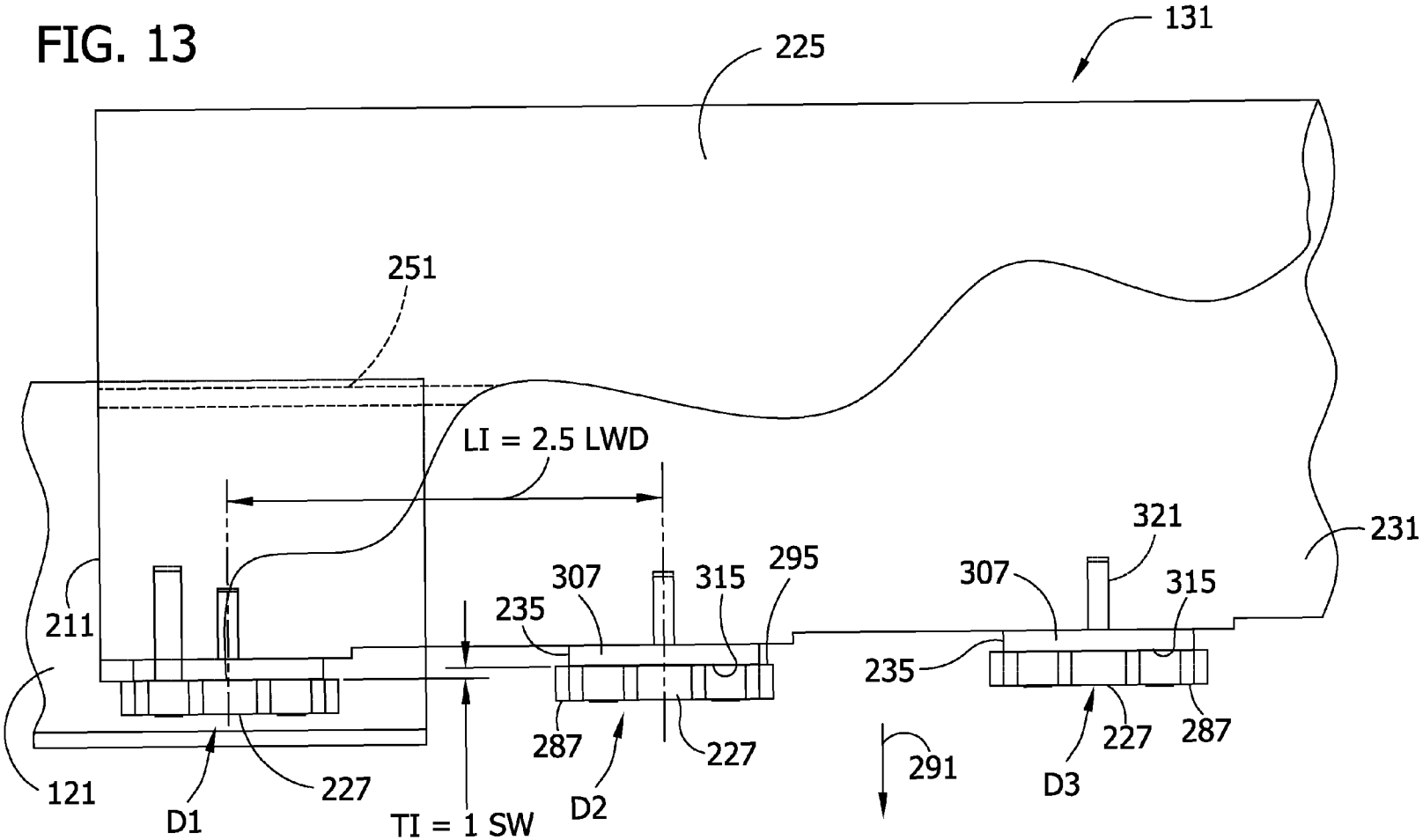
FIG. 13 is a top plan of expanding apparatus of the system with portions of a top die plate broken away to show details.
Figure 14:
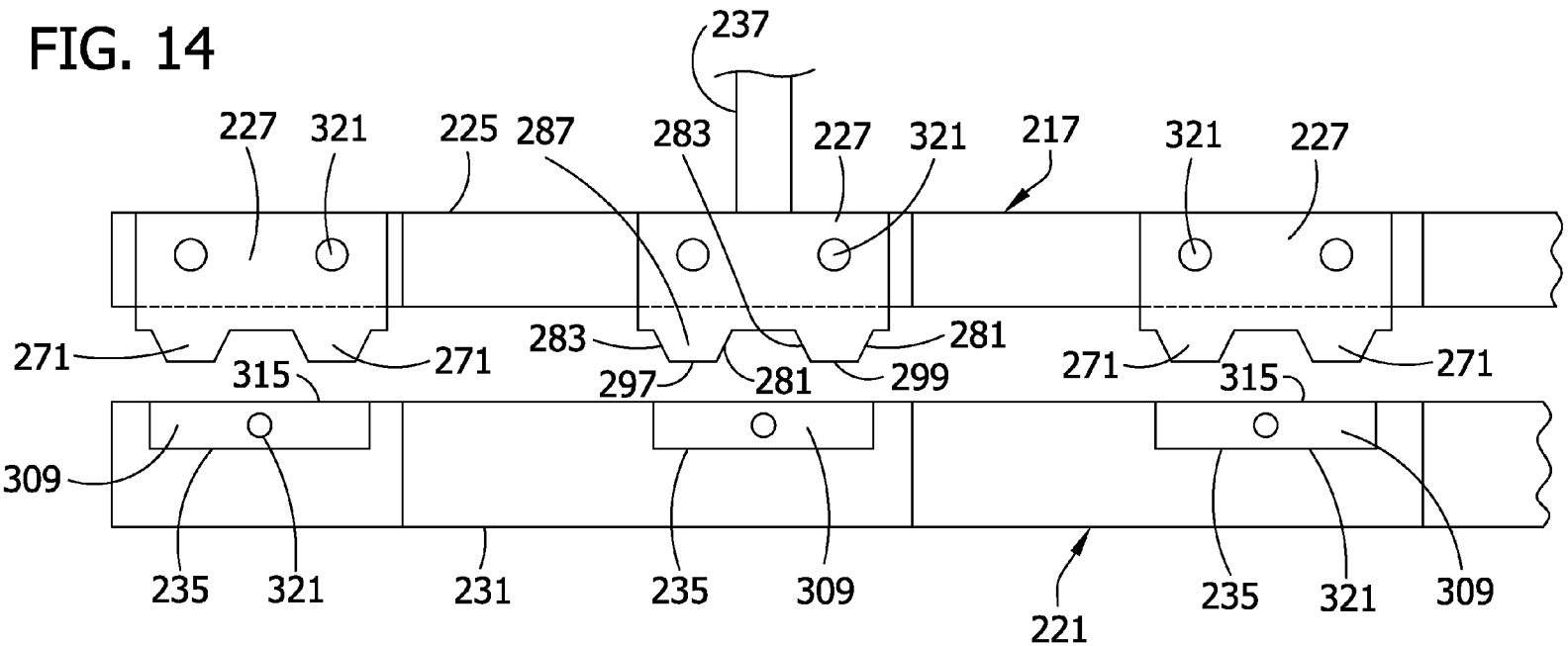
FIG. 14 is a side elevation of the expanding apparatus of FIG. 13.
Figure 15:
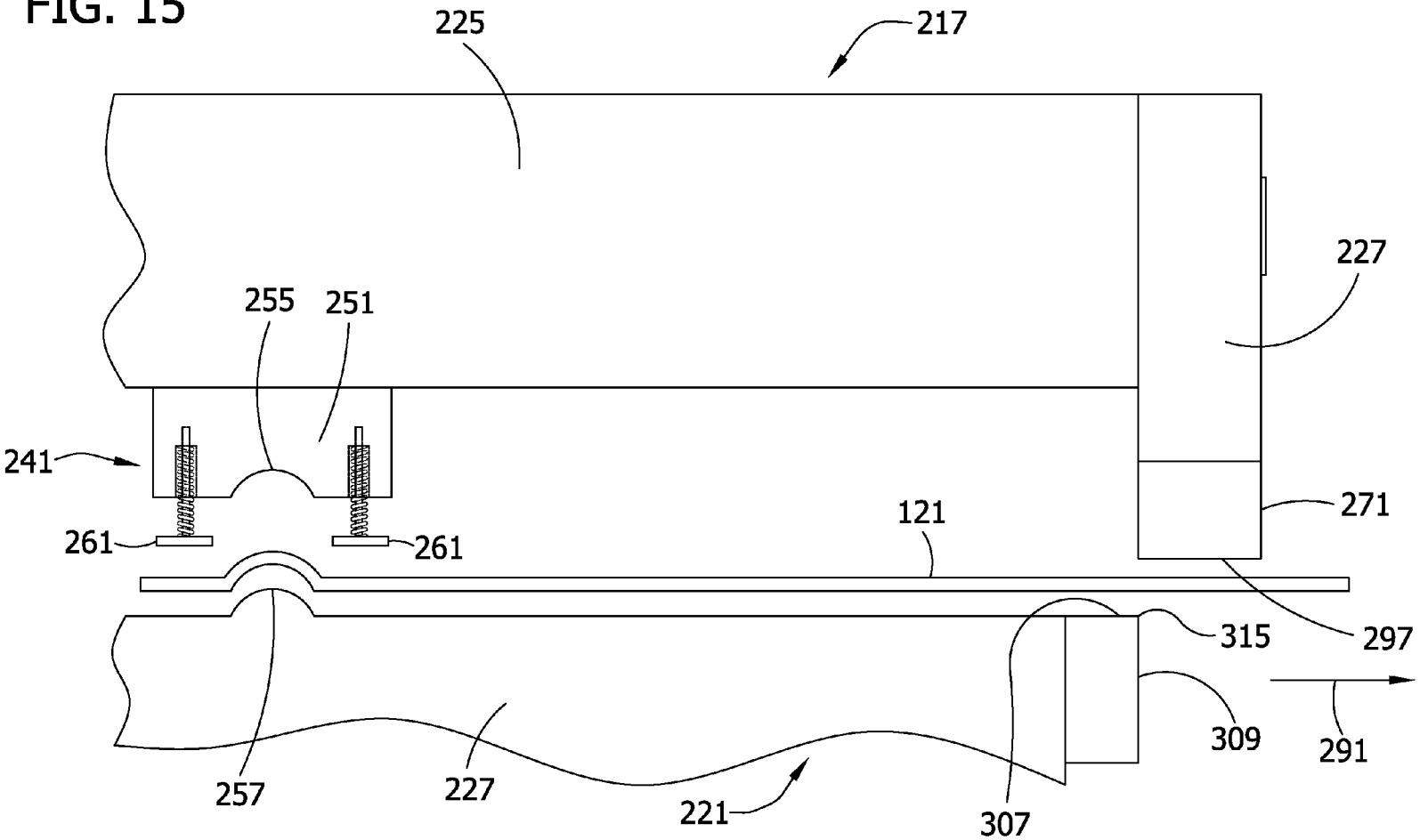
FIG. 15 is partial left-end view of the expanding apparatus of FIG. 13.

FIGS. 13-15 illustrate one embodiment of the expanding apparatus 131. The apparatus has a web-entry side 211, a web-exit side 215, and opposing first (e.g., upper) and second (e.g., lower) die assemblies indicated at 217 and 221 respectively. The upper die assembly 217 includes an upper die plate 225 with a series of forming dies 227 mounted on the plate. The lower die assembly 221 includes a lower die plate 231 with a series of lower cutting dies 235 mounted on the plate. The upper and/or lower dies 227, 235 are movable toward and away from one another to form holes 105 in the web 121 accompanied by an expansion of the web in a direction extending generally widthwise of the web (i.e., transversely of the web and the direction of web feed), as described in more detail below. A suitable drive mechanism 237 is provided to move the upper and/or lower die plates 225, 231 intermittently in cycles toward and away from one another to perform this operation. In one embodiment, the upper die plate 225 mounting the forming dies 227 is reciprocated up and down and the lower die plate 231 mounting the cutting dies 235 remains stationary.

A suitable holding mechanism, generally designated 241 in FIG. 15, is provided for holding the web 121 in place as the holes 105 are being cut and formed in the web 121. (FIG. 15 is a schematic view in the direction of web feed as the web enters the machine.) The holding mechanism 241 comprises an elongate clamping bar 251 mounted on the upper die plate 225 in a position extending in the direction of web feed. (Only one end of the bar is shown in FIG. 15.) A groove 255 extends lengthwise of the clamping bar 251 for receiving a mating protrusion or bead 257 on the bottom die plate. The bead 257 is positioned for pressing a portion of the front solid edge margin 137 of the web 121 into the groove 255 of the clamping bar 251 to hold the web in fixed position when the holes 105 are being formed in the web. Resilient clamping members 261 engage the upper face of the web 121 on opposite sides of the bead 257 to assist in holding the web in place, especially before and after the bead 257 and groove 255 are in mating relationship. Other holding mechanisms may be used.

Referring to FIG. 14, each upper forming die 227 comprises a set of one or more forming blades 271, two such blades being shown by way of example. (The number of forming blades 271 in each set can vary, e.g., one, two, three, four or more.) Hereinafter, the leading forming blade 271 of an upper die 227 in the direction of web feed will be referred to as the "leading" blade and the trailing blade 271 of the upper die will be referred to as the "trailing" blade. Each of the two forming blades 271 has a front (leading) face 281 (FIG. 14), a rear (trailing) face 283, an outer side face 287 facing in an outward direction indicated by the arrow 291 in FIGS. 13 and 15, an inner side face 295, and a lower face 297 which intersects the inner face along a knife edge 301 extending lengthwise of the web. The front and rear faces 281, 283 taper in a downward direction, and the front face 281 of the trailing blade 271 is spaced back from the rear face 283 of the leading blade 271. Each lower cutting die 235 comprises a cutting blade 305 having an upper face 307 and an outer face 309 which intersect along a knife edge 315. The upper and lower dies 227, 235 are secured to respective die plates 225, 231 by suitable fasteners 321, e.g., threaded fasteners. For convenience, each upper die and its cooperating lower die shall be referred to as a "die set", and the die sets are labeled D1, D2, D3 . . . DN in the direction of web feed.

During a down-stroke of the upper die assembly 217, the knife edges 301, 315 of each die set D will cut two longitudinal slits in the web 121 in a longitudinal direction, and further downward movement of the forming dies 227 expands the cut metal transversely of the slits to form two one-half diamonds 105 in the web. As used herein, a "one-half diamond" means one-half the area of a fully formed diamond extending in the LWD direction on one side of the longitudinal axis of the diamond. By way of example, FIG. 10 illustrates a series of diamond-shaped holes 105 or "diamonds" formed in a web. Each diamond has a longitudinal axis or centerline LC extending in the direction of web feed, a transverse axis or centerline TC extending at right angles to the direction of web feed, a first one-half diamond 105A on one side of the longitudinal centerline LC defined by two strands S1, S2, and a second one-half diamond 105B on the other side of the longitudinal centerline defined by two strands S3, S4. In the described embodiment where each forming die 221 has two forming blades 271, each down-stroke of the two blades will form to one-half diamonds 105A in a longitudinal row R of diamonds. In general, each die set D will form a number of one-half diamonds corresponding to the number of forming blades 271 in the die set (e.g., one, two, three or more), and all of the one-half diamonds thus formed will lie in a single longitudinal row R of diamonds extending along the web 121 in the direction of web feed.

Referring to FIG. 13, the die sets D1, D2 . . . DN are arranged in a stepped formation in which they are spaced at substantially equal longitudinal intervals LI parallel to the direction of web feed (left to right in FIG. 13), and in which they are also spaced at substantially equal transverse intervals TI at right angles to the direction of web feed. Specifically, the die sets are spaced at longitudinal intervals LI corresponding to a whole number multiple of the LWD dimension plus an additional 0.5 LWD. Thus, the longitudinal interval LI can be 1.5 LWD, 2.5 LWD, 3.5 LWD, etc., and in one desirable embodiment, the longitudinal interval is 2.5 LWD (see FIG. 13). Further, the die sets are spaced at transverse intervals TI corresponding to one strand width SW (e.g., 1/16 in.). The number of die sets D1, D2 . . . DN used will depend on the desired number of longitudinal rows R of holes 105. In general, one die set D is needed for each such row R. For example, if the expanded metal section of the gutter cover is to have twenty rows R1, R2, R3 . . . R20 of diamonds, then twenty die sets D1, D2 . . . D20 are needed, the first die set D1 starting the formation of the diamonds in the first longitudinal row R, the second die set D2 starting the formation of the diamonds in the second longitudinal row R2, and so forth, as described below.

In operation, the expanding apparatus 131 operates in successive cycles. Each cycle comprises the steps of feeding or advancing the solid web 121 into the machine a predetermined distance, moving the upper die assembly 217 through a down-stroke to cut and form holes 105 (e.g., diamonds) in the web, and moving the upper die assembly through an upstroke to prepare for the start of the next cycle. In general, at the start of each cycle, the web is advanced a distance equal to one diamond length (one LWD) times the number of forming blades 271 in each upper die 271. Thus, in the illustrated embodiment where each forming die has two blades, the web is advanced a distance of 2 LWD per cycle.

Figure 16:
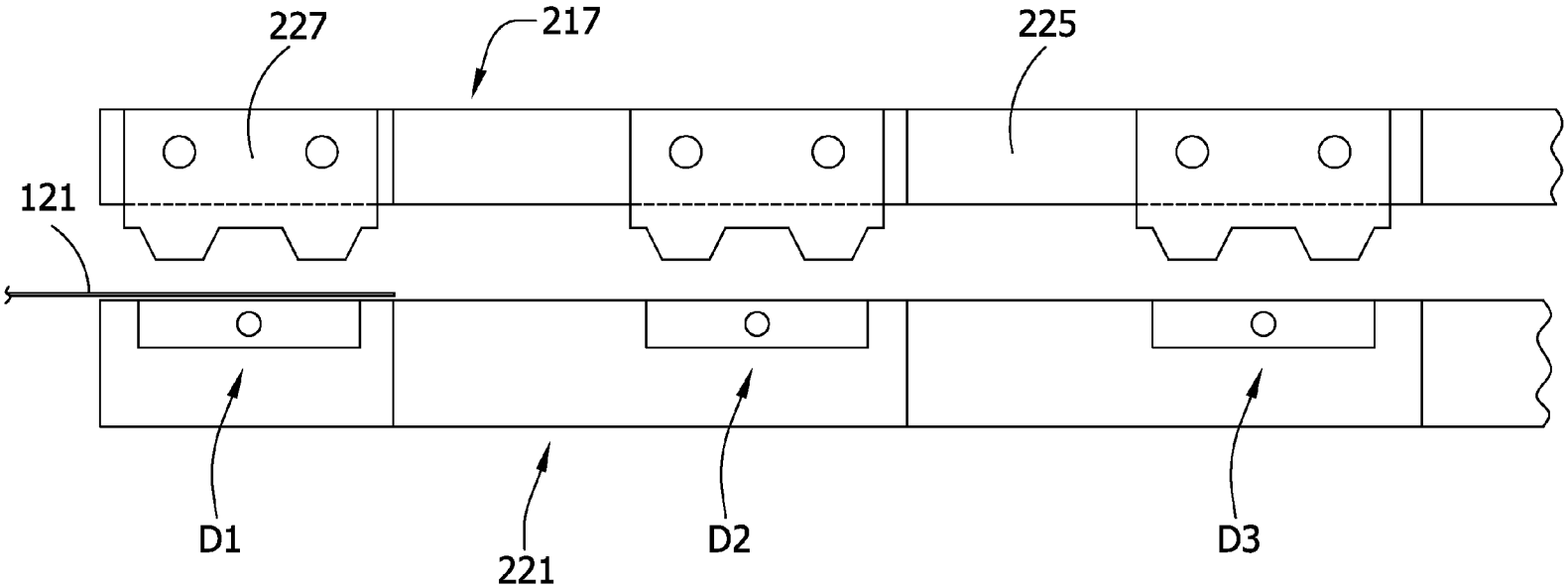
FIGS. 16-26 are views illustrating successive steps of one embodiment of a continuous method of this invention for making the one-piece gutter cover.
Figure 17:
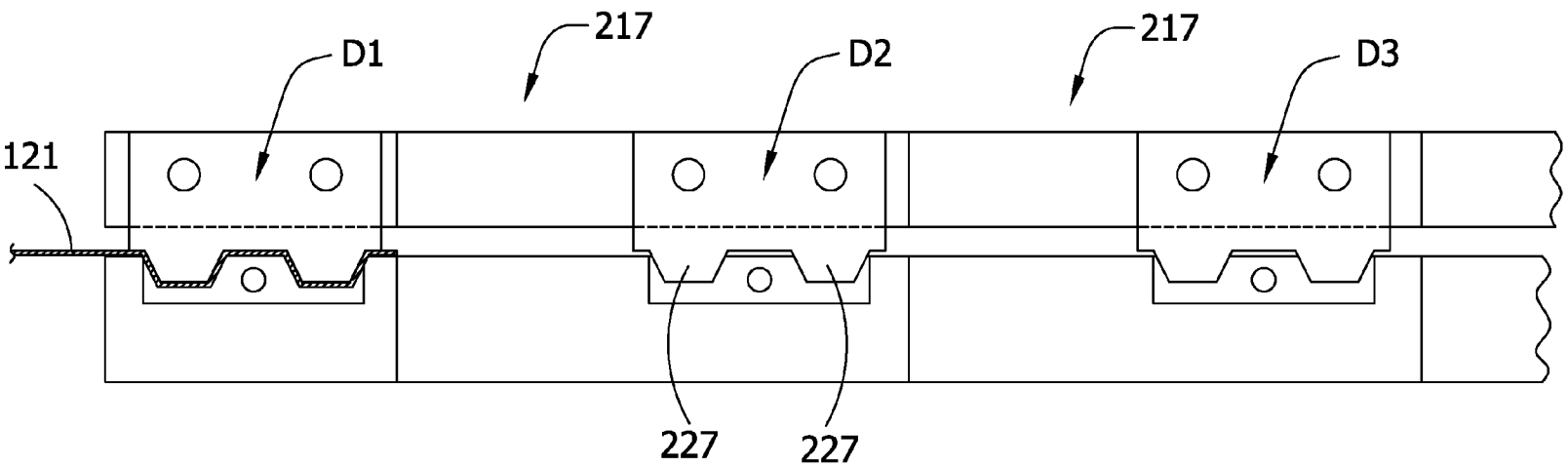
Figure 18:
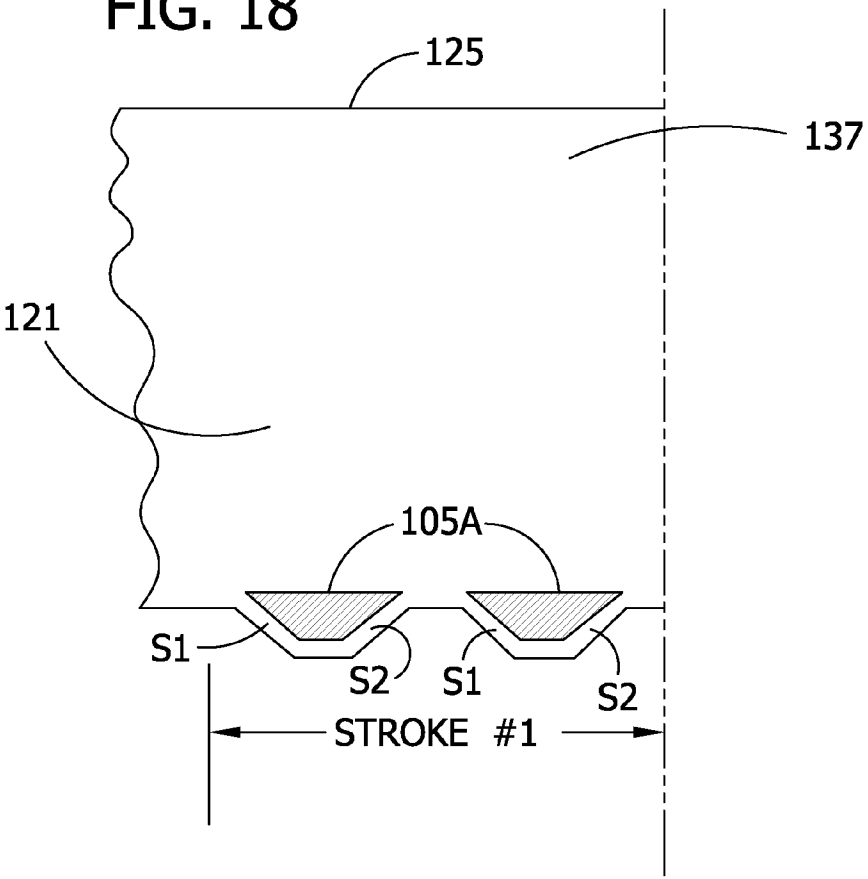

FIGS. 16-26 are schematic views illustrating how holes 105 (e.g., diamonds) are cut and formed in the web 121 during successive cycles of the expanding apparatus 131. FIG. 14 shows the machine at the start of the process. With the upper die plate 225 in a raised position, the web 121 is advanced into the machine to a position below the upper forming die 227 of the first die set DS1 (FIG. 16). When the web is in position, the upper die assembly 217 is moved through a first down-stroke to cut and form two one-half diamonds 105A (FIGS. 17 and 18) in what will eventually become the first longitudinal row R1 of diamonds along the rear edge of the gutter cover. The upper die assembly 217 is then moved through an upstroke and the web is advanced a distance of 2 LWD to the position shown in FIG. 19 in which the leading edge of the web is positioned below the trailing forming blade 227 of the second die set D2.

Figure 19:
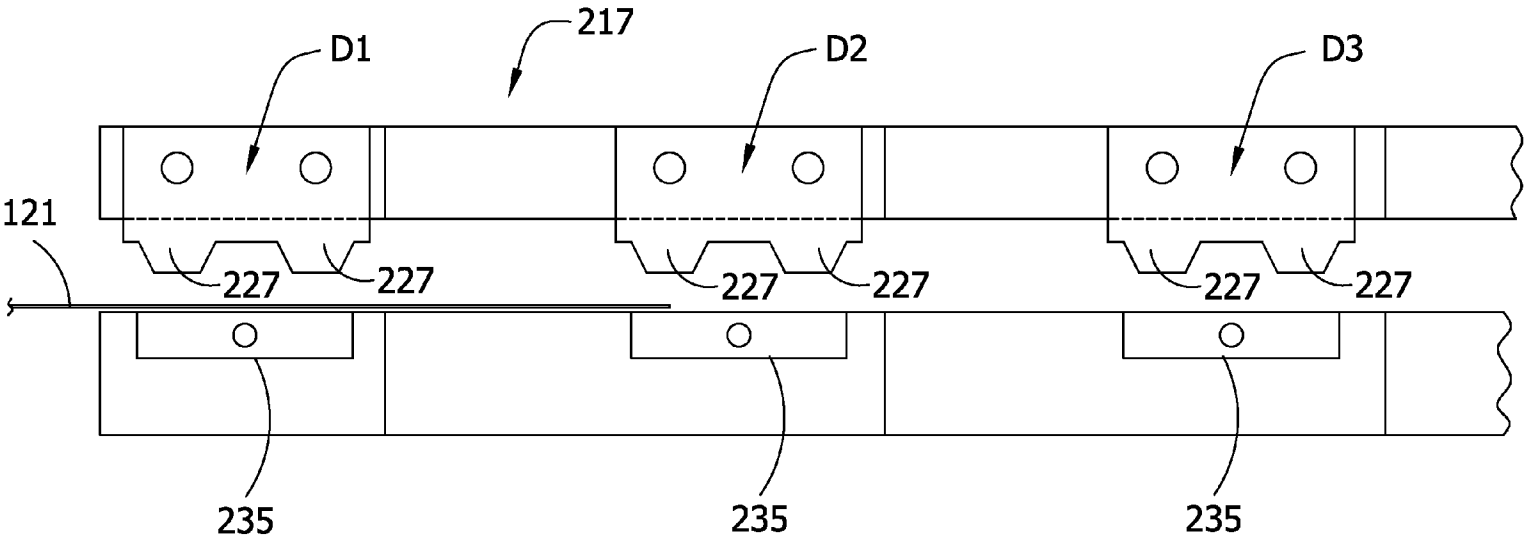
Figure 20:
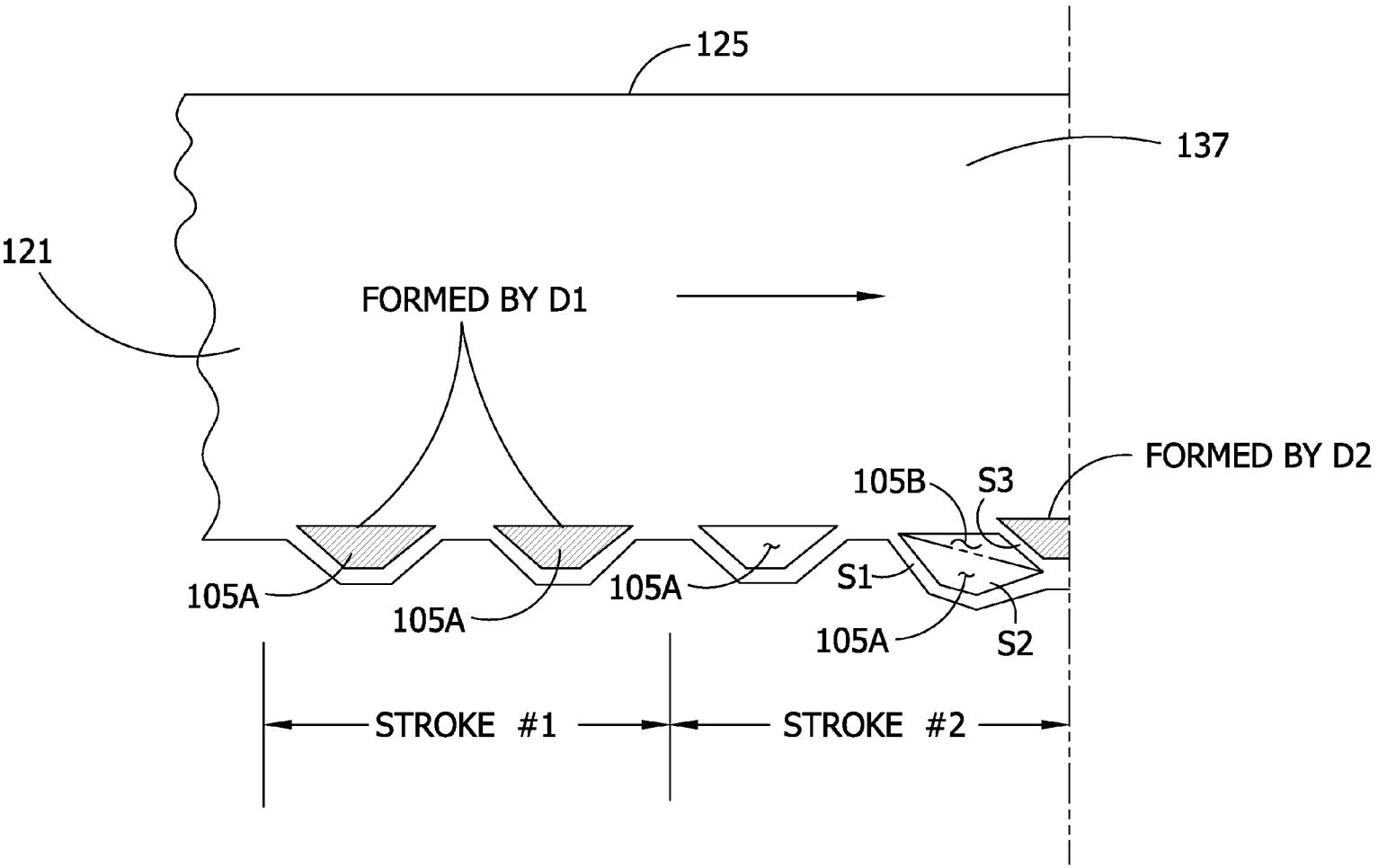

Once the web is in the position of FIG. 19, the upper die assembly 217 moves through a second down-stroke to form the additional one-half diamonds indicated by shading in FIG. 20. It will be noted that the hole 105 formed by the trailing forming blade 271 of the second die set D2 is somewhat less than a full one-half diamond 105A and is the start of the first diamond in the second row R2 of diamonds of a gutter cover adjacent the rear edge of the gutter cover. Further, the formation of this partial diamond expands the immediately trailing one-half diamond 105A in the first row R of diamonds by forming the third strand S3 (the upper right strand) of that diamond. The upper die assembly 217 is then moved through an upstroke and the web is advanced a distance of 2 LWD to the position shown in FIG. 21 in which the leading edge of the web is beyond the second die set D2.

Figure 21:
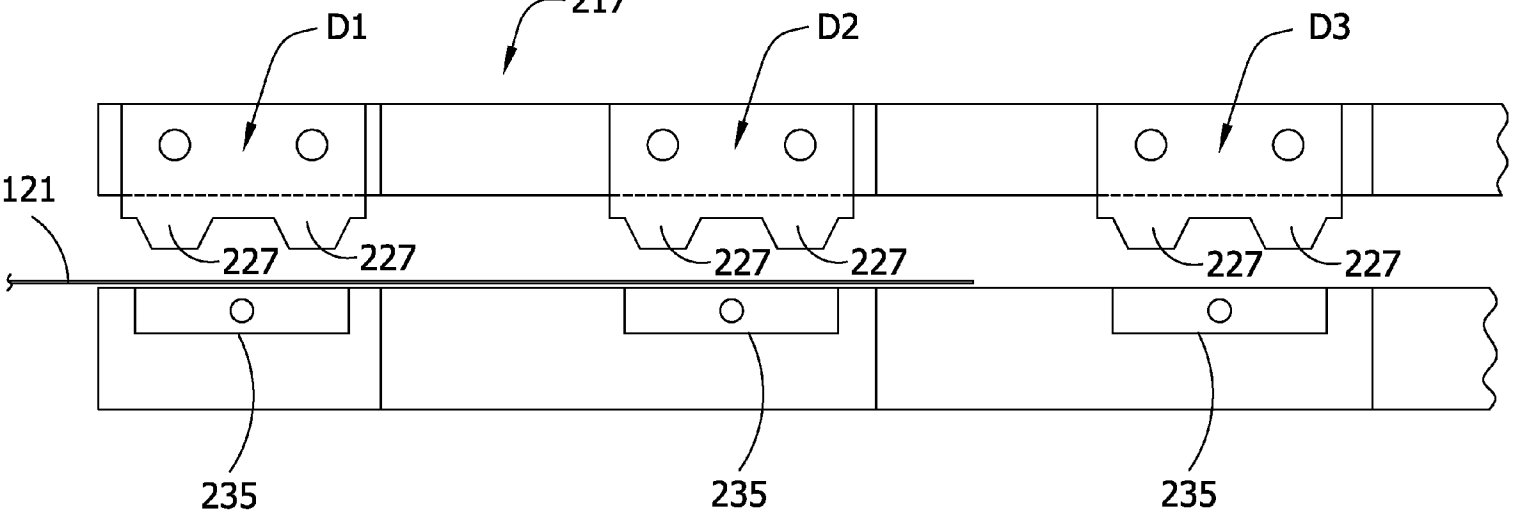
Figure 22:
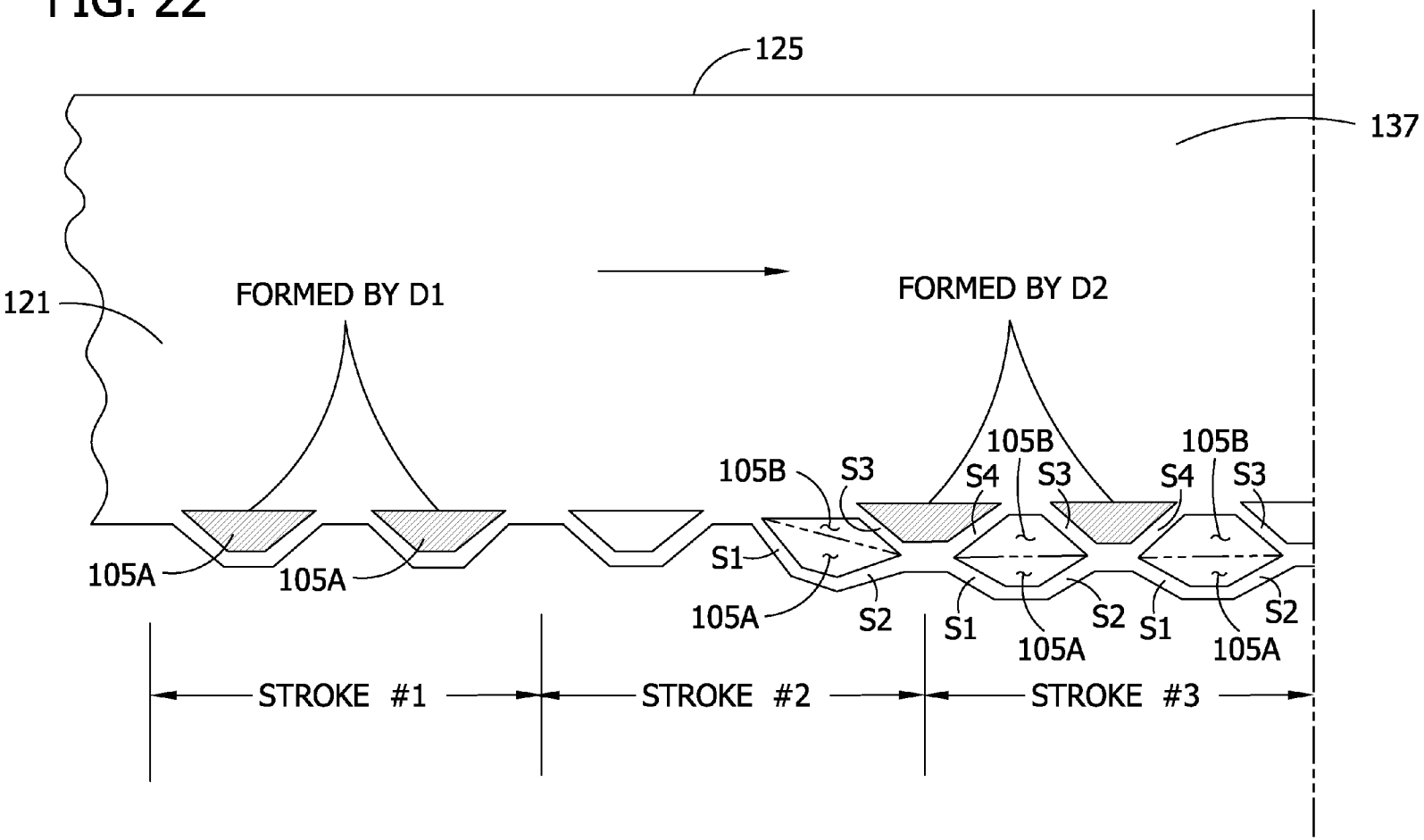

With the web in the position of FIG. 21, the upper die assembly 217 moves through a third down-stroke to form the additional one-half diamonds indicated by shading in FIG. 22. It will be noted that the hole 105A formed by the leading forming blade 271 of the second die set D2 during this down-stroke is a full one-half diamond 105A in the second row R2 of diamonds, and that the formation of this one-half diamond expands the immediately leading one-half diamond 105B by forming the fourth strand S4 (the upper left strand) of that diamond. (This completed diamond 105 is one diamond in the first row R1 of diamonds adjacent the rear edge of a completed gutter cover.) The trailing forming blade 271 of the second die set D2 also forms a one-half diamond 105B in the second row R2 of diamonds, and this formation expands the immediately trailing one-half diamond 105B by forming the third strand S3 (the upper right strand) of that diamond in the first row R1 of diamonds, as described during the preceding cycle. The upper die assembly 217 is then moved through an upstroke and the web 121 is advanced a distance of 2 LWD to the position shown in FIG. 23 in which the leading edge of the web is disposed between the leading and trailing forming blades 271 of the third die set D3.

Figure 23:
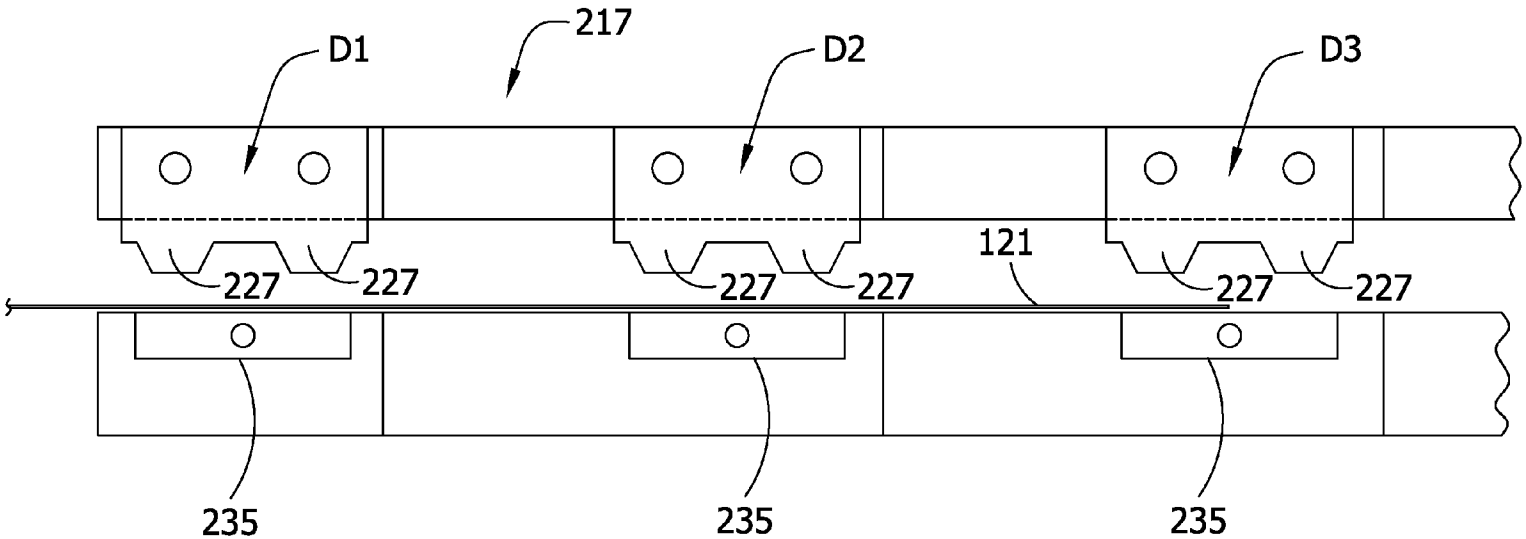
Figure 24:
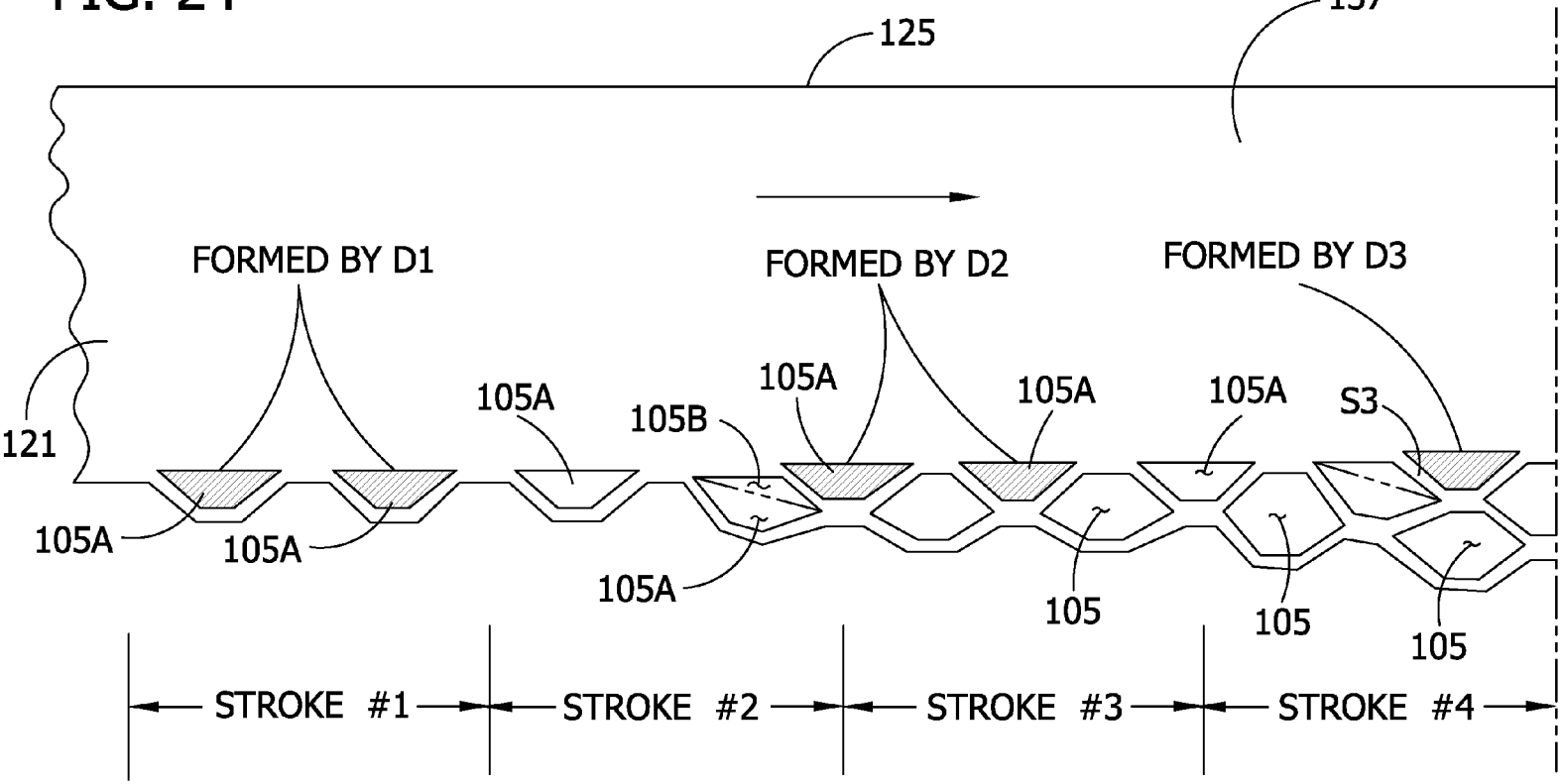

With the web in the position of FIG. 23, the upper die assembly 217 moves through a fourth down-stroke to form the additional one-half diamonds 105A, 105B indicated by shading in FIG. 24. It will be noted that the hole formed by the trailing forming blade 271 of the third die set D3 during this down-stroke is a full one-half diamond 105A in the third row of diamonds R3, and that the formation of this one-half diamond expands the immediately trailing one-half diamond by forming the third (upper left) S3 strand of that diamond, which is in the second row of diamonds. The first and second die sets D1, D2 operate in the same manner described in the preceding cycles. The upper die assembly 217 is then moved through an upstroke and the web is advanced a distance of 2 LWD to the position shown in FIG. 25 in which the leading edge of the web is beyond the leading forming blade 271 of the third die set D3.

Figure 25:
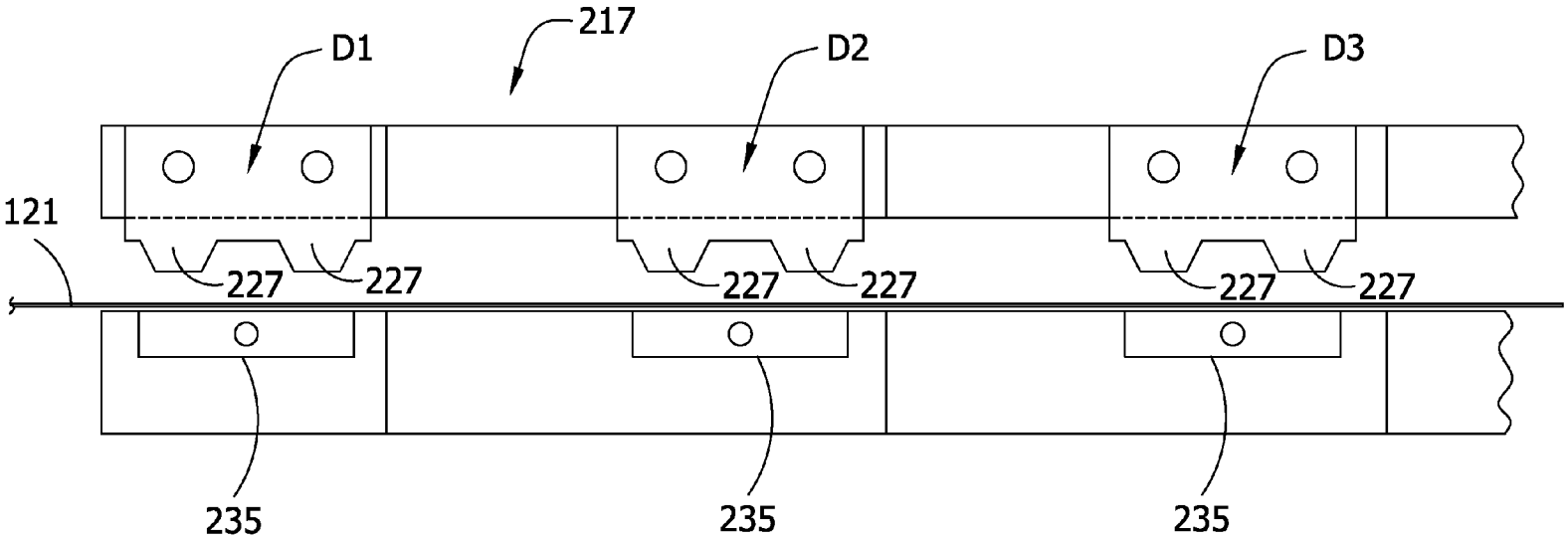
Figure 26:
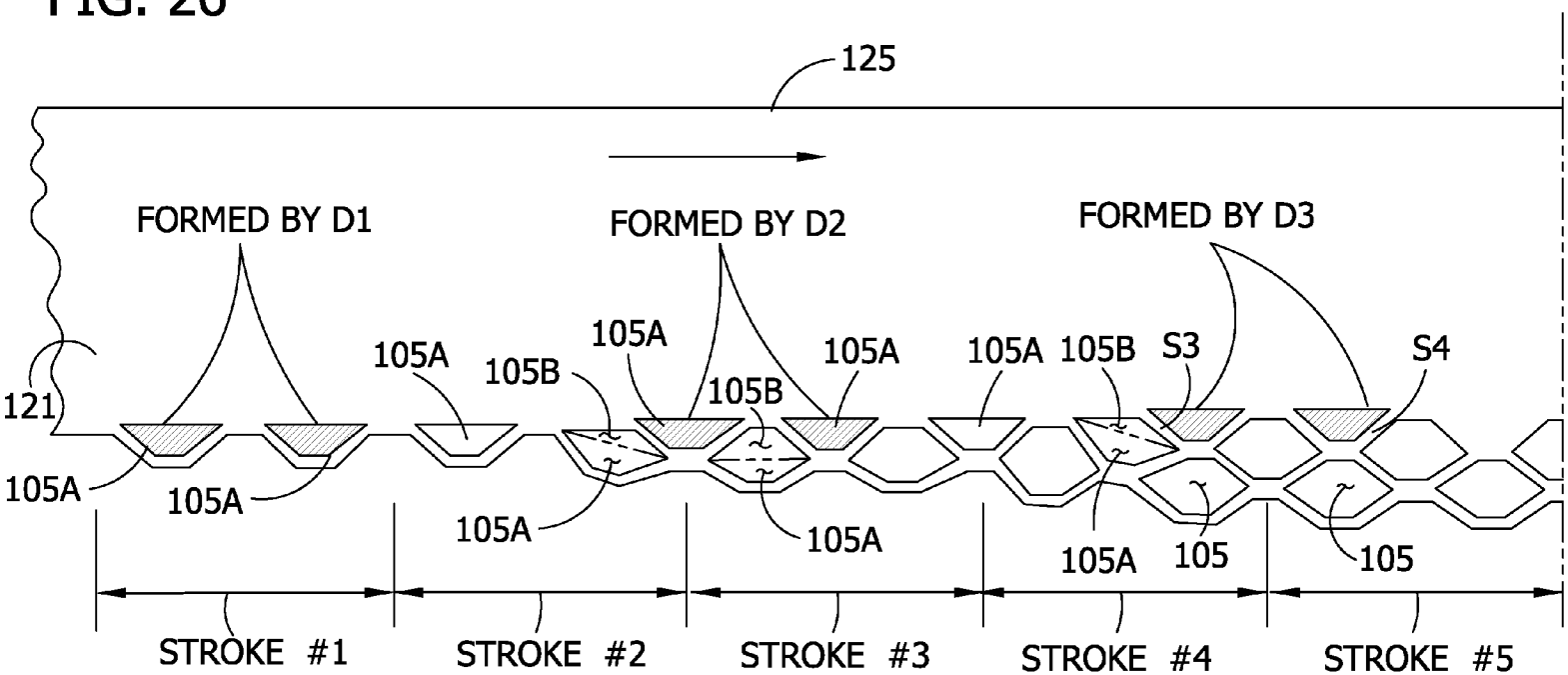

With the web in the position of FIG. 25, the upper die assembly 217 moves through a fifth down-stroke to form the additional one-half diamonds indicated by shading in FIG. 26. It will be noted that the hole formed by the leading forming blade 271 of the third die set D3 during this down-stroke is a full one-half diamond in the third row R3 of diamonds, and that the formation of this one-half diamond expands the immediately leading one-half diamond by forming the fourth strand S4 (the upper left strand) of that diamond, which is in the second row R2 of diamonds. The trailing forming blade 271 of the third die set DS3 also forms a one-half diamond, and this formation expands the immediately trailing one-half diamond in the second row of diamonds by forming the third strand S3 (the upper right strand) of that diamond, which is in the second row R2 of diamonds. The upper die assembly 217 is then moved through an upstroke and the web is advanced a distance of 2 LWD to the next position prior to a sixth down-stroke.

Figure 27:
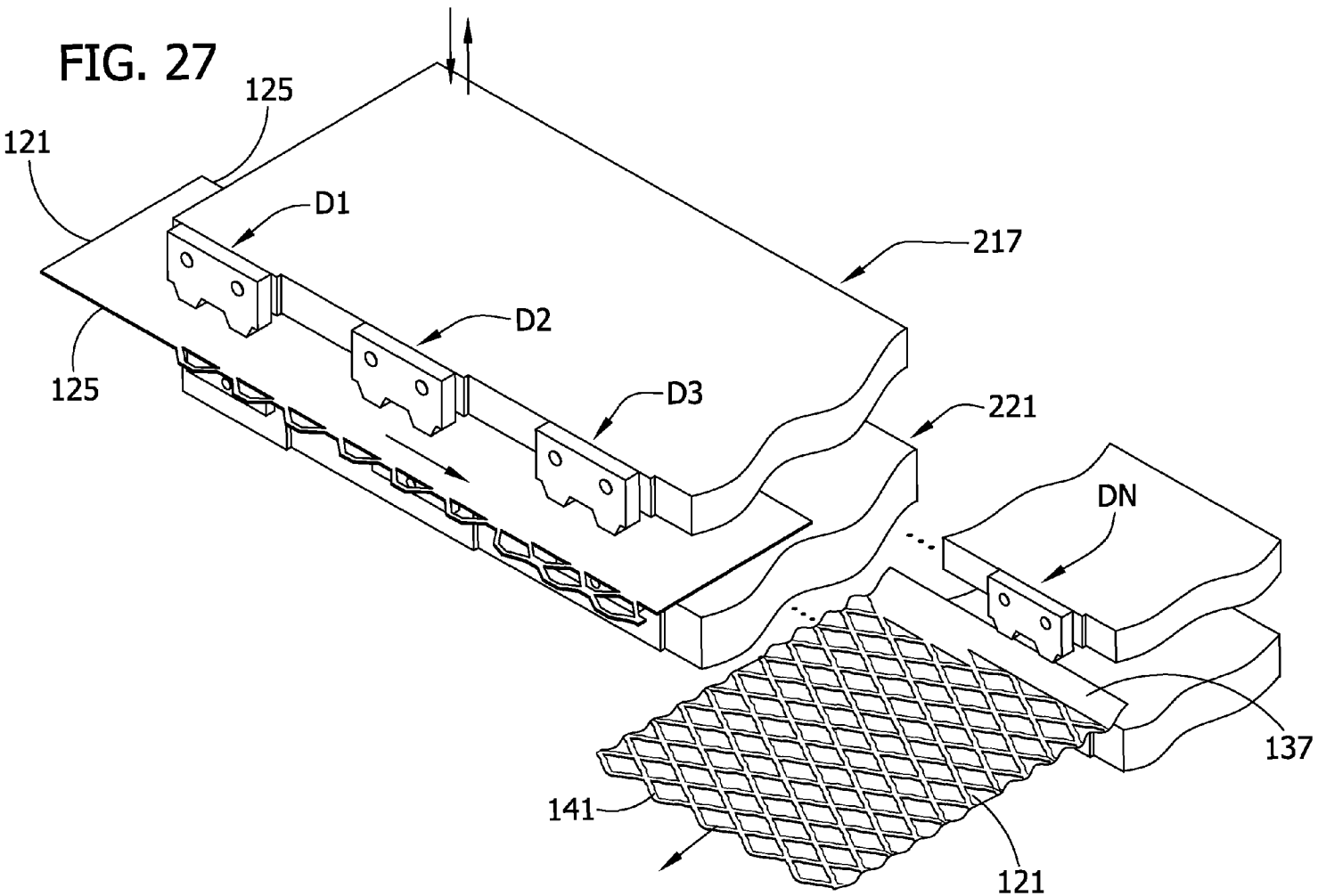
FIG. 27 is a perspective schematic view showing the web immediately before exit from the expanding machine.

The cycles repeat until the rows of diamonds R1, R2 . . . RN are completely formed (see FIG. 27). The upper and lower die assemblies 217, 221 do not act on the solid front edge margin 137 of the web 121 which remains solid and unperforated. As noted previously, the machine is provided with a suitable mechanism (e.g., 241) which operates to hold the solid front edge margin 137 of the web 121 in fixed position during the cutting and forming (expanding) operation of the machine and to release the front edge margin to permit intermittent feeding of the web through the system.

In the process described above, only one edge margin 137 corresponding to the front edge margin of the gutter cover remains solid. Openings 105 are formed in the other edge margin 141 corresponding to the rear edge margin of the gutter cover. It will be observed that this rear edge margin includes a "bonded" edge (see FIG. 5). If both the front and rear edge margins 137, 141 of the finished gutter cover are to be solid, then the upper and lower die assemblies 217, 221 are located so that they do not act on either edge margin, i.e., the edge margins remain solid and unperforated.

The width of the expanded metal section 135 (i.e., the number of rows R and/or the SWD dimensions of the holes 105), the width of the solid front edge margin 137, and the width of any solid rear edge margin 141 can be varied as needed or desired. By way of example, the web of material 121 exiting the expanding apparatus 131 may have a solid front edge margin 137 with a width in the range of about ⅛ in. to about 1¼ in. (e.g., about 9/16 in.) and an expanded metal section 135 having a width in the range of about 4 in. to about 8 in. (e.g., about 5 in.). In another embodiment where both the front and rear edge margins 137, 141 are solid, the web 121 of material exiting the expanding machine may have a solid front edge margin 137 with a width in the range of about ⅛ in. to about 1¼ in. (e.g., about 9/16 in.), an expanded metal section 135 having a width in the range of about 4 in. to about 8 in. (e.g., about 5 in.), and a solid rear edge margin 141 having a width in the range of about ⅛ in. to about 1¼ in. (e.g., about ¼ in.).

Expanding apparatus other than apparatus 131 of the type described above may be used to form the expanded metal section of the gutter cover. By way of example, rotary expanding apparatus may be used. In this type of apparatus, the expanded metal openings are formed by slitting the web using rotary knives and applying a transverse stretching force to the web to expand the slits widthwise relative to the web to form the openings.

Figure 28:
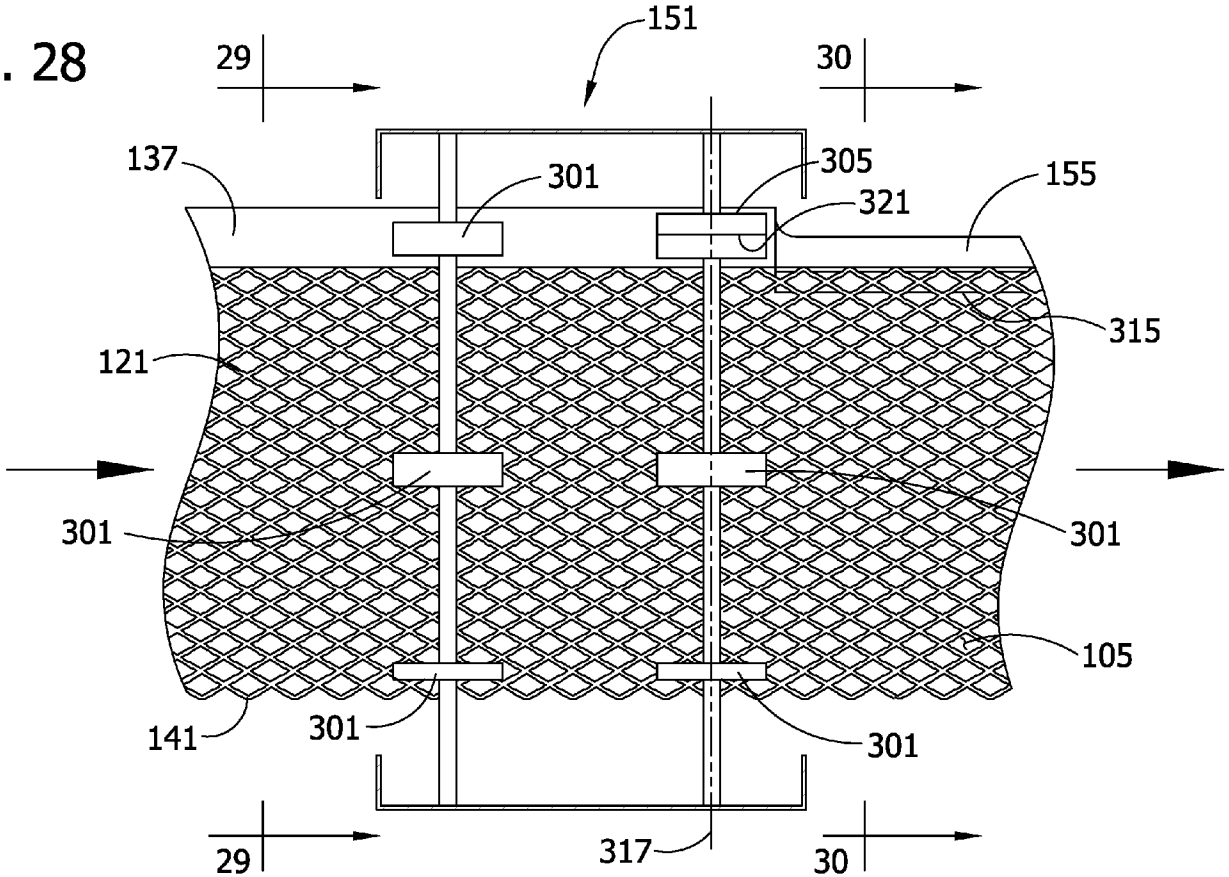
FIG. 28 is a plan view of one embodiment of profiling apparatus of the system.
Figure 29:
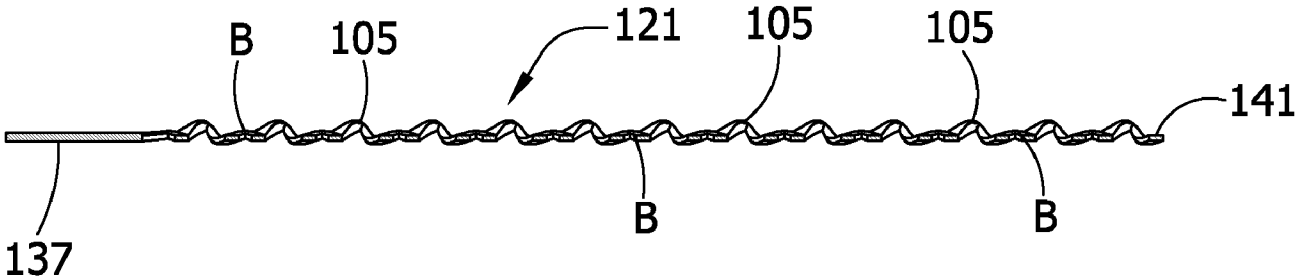
FIG. 29 is a section taken along lines 29-29 of FIG. 28.

Referring to FIG. 28, the profiling apparatus 151 comprises a series of guide rolls 301 and at least one forming roll 305 which functions to bend the solid side edge margin 137 of the web into a desired profile 155 corresponding to the front solid edge margin of the finished gutter cover. If desired, the other (rear) side edge margin 141 corresponding to the rear solid edge margin of the finished gutter cover may also be bent to a desired profile using a forming roll (not shown). The forming roll 315 is mounted for rotation about an axis 317 extending transverse to the direction of web feed and has a circumferential surface 321 configured (e.g., grooved) for bending the side edge margin 137 of the web, as will be understood by those skilled in this art.

The cutting apparatus 171 comprises a cutting mechanism (e.g., shears) for cutting the continuous web 121, now expanded and profiled, generally transversely of the web and at intervals spaced along the web (each interval corresponds to the length of the finished cutter cover) to form individual and separate gutter covers 181 (see FIGS. 11 and 12). Specifically, the cutting of the continuous web 121 is along transverse cut lines 351 (FIG. 12) forming the short end edges of a finished gutter cover. The finished gutter covers 181 are delivered by suitable means (e.g., a chute) to destination such as a boxing table where they are loaded into suitable packaging 361 (e.g., carton) or otherwise stored for further processing.

As noted previously, the above method of this invention differs from conventional methods of making expanded metal gutter covers. In conventional methods, a solid web of metal is fed from a coil having a width (e.g., 48 inches) corresponding to the final length of a gutter cover. The metal is fed from the coil to an expanding machine where it is expanded to a predetermined dimension (e.g., six or seven inches) somewhat greater than the final width (e.g., five or six inches) of a gutter cover, and then cut to form an expanded metal blank. The blank is then transferred (e.g., hand carried) to a profiling machine where it is fed into the machine and profiled to complete the cover. This two-step "batch" process involved setting up and maintaining two separate lines to make a finished gutter cover. The "continuous" process method of the present invention represents a substantial improvement over the two-step "batch" process because it permits the expanding, profiling and cutting steps to be completed using only one production line. Further, gutter covers made using the continuous process are more uniform, resulting in fewer defective parts to be scrapped.

Figure 30:
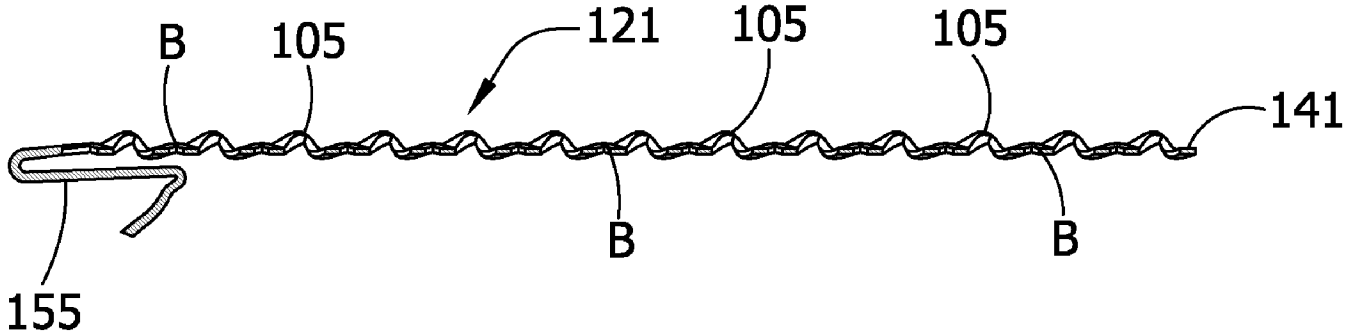
FIG. 30 is a section taken along lines 30-30 of FIG. 28.
Figure 31:
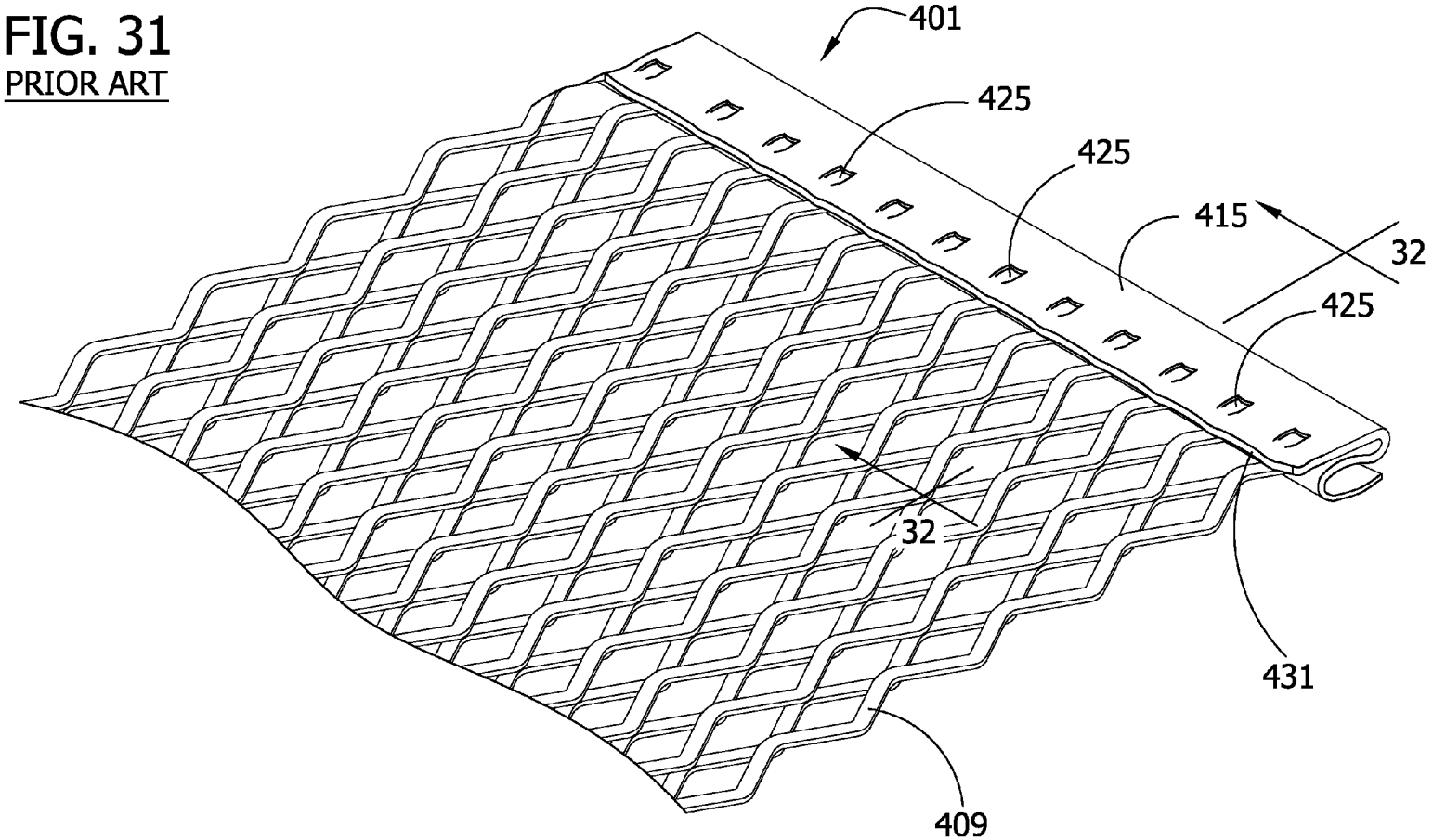
FIG. 31 PRIOR ART
FIG. 31 is a partial perspective view of a prior art two-piece gutter cover.
Figure 32:
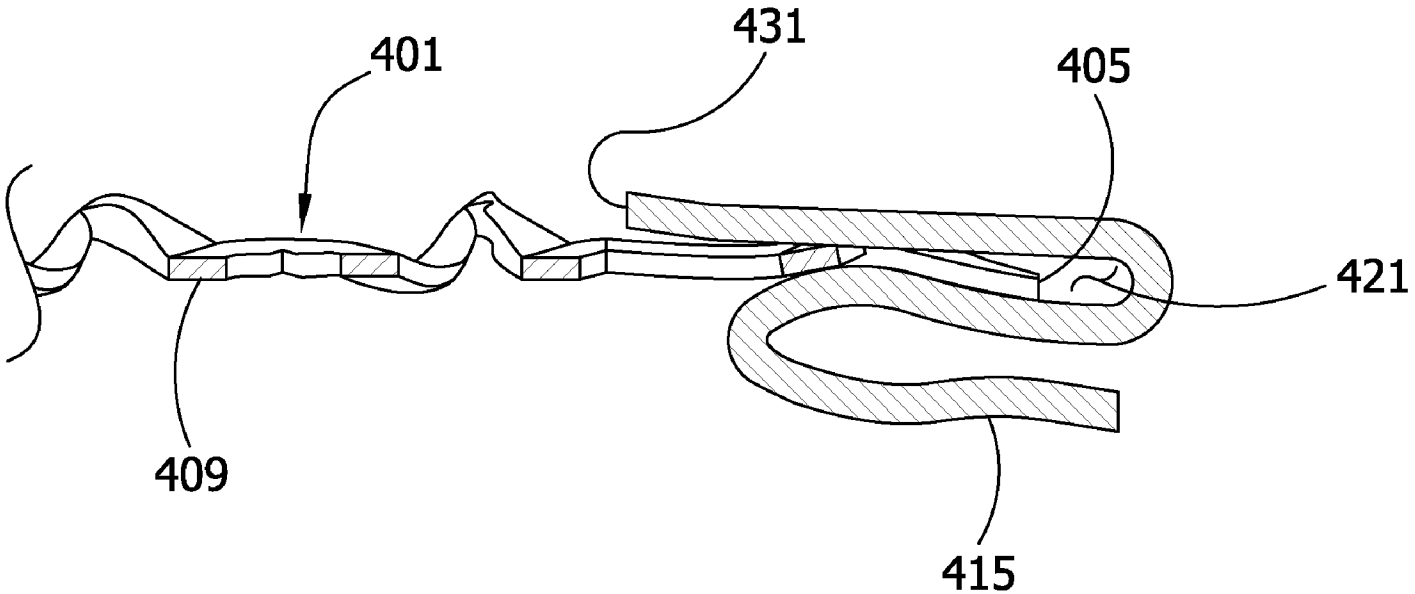
FIG. 32 PRIOR ART
FIG. 32 is a sectional view taken along lines 32-32 of FIG. 31.

The one-piece gutter covers 181 formed as described above in accordance with one embodiment of a method of this invention represent a substantial improvement over a conventional two-piece gutter cover, such as the gutter cover 401 shown in FIGS. 31 and 32. In the gutter cover 401, the raw front edge 405 of the expanded metal section 409 is covered by a solid metal strip 415 that is made separate from the expanded metal section. This metal strip 415 is roll-formed into a Z-shaped cross section on a roll-forming machine, and the sharp front edge 405 of the expanded metal section 409 is inserted into one of the channels 421 of the Z-shaped strip. A pinch roller or the like is then used to fasten the strip 415 to the expanded metal section 409 at crimp locations 425 along the strip, as shown in FIG. 30. While the strip 415 functions to cover the sharp edge 405 along the front of the expanded metal section, the process is labor-intensive and thus costly. Further, the joint between the bar 415 and the expanded metal 409 creates an upstanding irregular seam 431 which tends to catch and hold leaves and other debris (e.g., leaves) which will interfere with the proper drainage of water into the gutter.

On the other hand, a one-piece gutter cover 181 of the present invention is formed from a single piece of metal having both an expanded metal section adapted to cover the gutter and a solid unperforated front edge margin for facilitating safe handling of the screen, for ease of installation, and for stiffening the gutter screen. The rear edge margin may also be solid (unperforated). Because the gutter screen is integrally formed from a single piece of material, the upstanding irregular seam 431 of the prior art between the expanded metal and the separate solid metal strip 415 is completely eliminated, and the likelihood that the gutter screen will become clogged is reduced.

Figure 6:
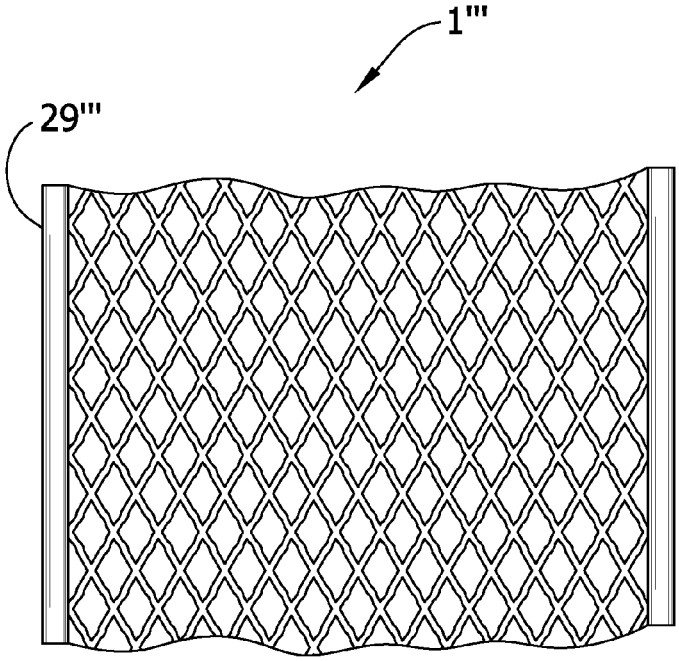
FIG. 6 is a fragmentary plan view of yet another embodiment of the gutter screen.

FIGS. 3 and 6 show one embodiment of a one-piece gutter cover 1 made in accordance with the present invention. The gutter cover has a solid front edge margin 33 and a solid rear edge margin 29. It will be noted that the junctions or seam areas between the expanded metal section 40 and the solid front and rear edge margins 29, 33 are smooth and regular so that debris will not be snagged. Similarly, FIG. 5 illustrated a one-piece gutter cover 1" of this invention having only a solid front edge margin 33". The junction or seam area between the expanded metal section and the solid front edge margin is smooth and regular.

Another advantage of the method described above is that in the embodiment of FIG. 5, the perforated rear edge of the gutter cover is not a "cut" or raw edge. Rather, the edge is a smooth "bonded" edge corresponding to the smooth edge of the solid web 121. As a result, the operator and/or installer is less likely to cut his or her hands, and the rear edge of the gutter cover will not snag on shingles during installation, making the cover easier to install. This is in contrast to the conventional process, where the longitudinal side edges of the gutter cover are cut and raw.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above constructions and methods without departing from the scope of the invention, it is intended that all matter contained in the above description or shown in the accompanying drawings shall be interpreted as illustrative and not in a limiting sense. For example, the various gutter screen profiles shown herein can be installed over the gutter in a variety of ways.

What is claimed is:

1. A method of continuously forming a one-piece expanded metal gutter cover having a length, a width, and at least one solid edge extending along the cover at one side of the cover, said method comprising feeding a continuous web of solid metal in a direction of feed along a continuous path, said continuous web having a width extending transverse to the web and direction of feed and side edges extending lengthwise of the web, expanding the continuous web in a direction transverse to the direction of feed and to the width of the web as it is fed along said continuous path to form an expanded web of material having an expanded metal screen section with holes of substantially uniform size and shape, a first side edge margin along one side of the web of solid unperforated metal, and a second side edge margin along an opposite side of the web, the expanded web having a width greater than the width of the continuous web of solid metal before said expanding, after said expanding has occurred, forming a gutter cover profile in the first side edge margin as the continuous web is fed along said continuous path, said profile having a configuration for installation on a gutter, after said forming has occurred, cutting the continuous web transversely of the web at intervals along the web to form separate gutter covers, each interval corresponding to the length of a gutter cover, wherein the holes formed in the expanded web are arranged in rows R1 . . . RN extending in the direction of feed, wherein said expanding comprises forming the holes in row R1 before forming the holes in row RN, and wherein said expanding comprises forming a first half of a hole in a row, advancing the web in the direction of feed, and forming a second half of the hole in the row.

2. The method of claim 1 wherein said expanding step comprises expanding the continuous web in a direction extending generally transverse to the web.

3. The method of claim 1 wherein said expanding step comprises forming elongate holes in the web having long dimensions running lengthwise of the continuous web.

4. The method of claim 3 wherein said holes are diamond shaped holes having a long dimension in the range of 0.25-0.63 in., and a short dimension in the range of 0.13-0.38 in.

5. The method of claim 3 wherein said holes are defined by metal strands having a strand width in the range of 0.02-0.05 in.

6. The method of claim 1 wherein said solid metal is aluminum.

7. The method of claim 1 wherein said cutting step forms end edges of the gutter cover extending transversely of the gutter cover, and wherein the longitudinal side edges of the web extend along the longitudinal side edge margins of a finished gutter cover.

8. The method of claim 1 wherein the holes in a row are formed by a plurality of rotary knives or die sets arranged in a stepped formation in which the rotary knives or die sets are spaced at longitudinal intervals along the direction of web feed and at transverse intervals with respect to the direction of web feed.

9. The method of claim 8 wherein each hole has a long dimension extending lengthwise of the web, and wherein said longitudinal intervals correspond to about a whole number multiple of said long dimension plus an additional one-half of said long dimension.

10. The method of claim 8 wherein said holes are defined by strands having a strand width, and wherein said transverse intervals correspond to about one strand width.

11. The method of claim 1, wherein said expanding comprises moving a die assembly to form slits in the continuous web extending in a direction lengthwise of the web, and moving the same die assembly a further distance to open the slits in a transverse direction to form said holes in the web.

12. The method of claim 11, wherein said die assembly comprises one or more forming blades, each forming blade having front and rear faces which taper in a downward direction, and wherein said method comprises moving said one or more forming blades downward to form and open said slits.

13. The method of claim 1, wherein the gutter covers formed by the method are substantially planar.

14. A method of continuously forming a one-piece expanded metal gutter cover having a length, a width, and at least one solid edge extending along the cover at one side of the cover, said method comprising feeding a continuous web of solid metal in a direction of feed along a continuous path, said continuous web having a width extending transverse to the web and direction of feed and side edges extending lengthwise of the web, expanding the continuous web in a direction transverse to the direction of feed and to the width of the web as it is fed along said continuous path to form an expanded web of material having an expanded metal screen section with holes of substantially uniform size and shape, a first side edge margin along one side of the web of solid unperforated metal, and a second side edge margin along an opposite side of the web, the expanded web having a width greater than the width of the continuous web of solid metal before said expanding, said expanding comprises moving a die assembly to form slits in the continuous web extending in a direction lengthwise of the web, and moving the same die assembly a further distance to open the slits to form said holes in the web, wherein the holes formed in the expanded web are arranged in rows R1 . . . RN extending in the direction of feed, wherein said expanding comprises forming the holes in row R1 before forming the holes in row RN, and wherein said expanding comprises forming a first half of a hole in a row, advancing the web in the direction of feed, and forming a second half of the hole in the row.

15. The method of claim 14, wherein said die assembly comprises one or more forming blades, each forming blade having front and rear faces which taper in a downward direction, and wherein said method comprises moving said one or more forming blades downward to form and open said slits.

16. The method of claim 14, wherein the gutter covers formed by the method are substantially planar.

* * * * *